US010701485B2

(12) United States Patent
Brunet et al.

(10) Patent No.: US 10,701,485 B2
(45) Date of Patent: Jun. 30, 2020

(54) ENERGY LIMITER FOR LOUDSPEAKER PROTECTION

(71) Applicant: Samsung Electronics Co., Ltd., Suwon-si (KR)

(72) Inventors: Pascal M. Brunet, Pasadena, CA (US); Glenn S. Kubota, Northridge, CA (US)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/224,604

(22) Filed: Dec. 18, 2018

(65) Prior Publication Data

US 2019/0281385 A1 Sep. 12, 2019

Related U.S. Application Data

(60) Provisional application No. 62/640,448, filed on Mar. 8, 2018.

(51) Int. Cl.

| | |
|---|---|
| ***H04R 3/00*** | (2006.01) |
| ***H04R 29/00*** | (2006.01) |
| *H04R 7/02* | (2006.01) |

(52) U.S. Cl.
CPC ..... *H04R 3/007* (2013.01); *H04R 29/001* (2013.01); *H04R 7/02* (2013.01)

(58) Field of Classification Search
CPC ..... H04R 3/007; H04R 3/00; H04R 29/00; H04R 29/001
(Continued)

(56) References Cited

U.S. PATENT DOCUMENTS 5,600,718 A 2/1997 Dent et al.
5,870,484 A 2/1999 Greenberger et al.
(Continued)

FOREIGN PATENT DOCUMENTS

CN 107872759 A 4/2018
EP 0548836 B1 11/1997
(Continued)

OTHER PUBLICATIONS

International Search Report and Written Opinion dated May 7, 2019 for International Application PCT/KR2019/001090 from Korean Intellectual Property Office, pp. 1-13, Republic of Korea.
(Continued)

*Primary Examiner* — Disler Paul
(74) *Attorney, Agent, or Firm* — Sherman IP LLP; Kenneth L. Sherman; Hemavathy Perumal

(57) ABSTRACT

One embodiment provides a method comprising determining a potential energy in a loudspeaker, a kinetic energy in the loudspeaker, and an electrical energy in the loudspeaker based on a physical model of the loudspeaker. The method further comprises determining a total energy stored in the loudspeaker based on the potential energy, the kinetic energy, and the electrical energy. The method further comprises determining a maximum potential displacement of a diaphragm of a speaker driver of the loudspeaker based on the total energy, and limiting the total energy stored in the loudspeaker by attenuating a source signal for reproduction via the loudspeaker. An actual displacement of the diaphragm during the reproduction of the source signal is controlled based on the attenuated source signal.

20 Claims, 11 Drawing Sheets

(58) Field of Classification Search
USPC ..... 381/55, 58–59
See application file for complete search history.

(56) References Cited

U.S. PATENT DOCUMENTS

| | | | | |
|---|---|---|---|---|
| 6,059,926 | A | 5/2000 | Hiroshima | |
| 6,275,592 | B1 | 8/2001 | Vartiainen | |
| 7,013,011 | B1 | 3/2006 | Weeks et al. | |
| 7,024,014 | B1 | 4/2006 | Noll | |
| 7,348,908 | B2 | 3/2008 | Slavin | |
| 7,359,519 | B2 | 4/2008 | Lee et al. | |
| 7,372,966 | B2 | 5/2008 | Bright | |
| 7,467,071 | B2 | 12/2008 | Manrique et al. | |
| 7,477,751 | B2 | 1/2009 | Lyon et al. | |
| 7,688,984 | B2 | 3/2010 | De Callafon | |
| 8,073,149 | B2 | 12/2011 | Kuze | |
| 8,086,956 | B2 | 12/2011 | Su et al. | |
| 8,130,994 | B2 | 3/2012 | Button et al. | |
| 8,146,989 | B2 | 4/2012 | Godiska et al. | |
| 8,204,210 | B2 | 6/2012 | van de Laar et al. | |
| 8,300,837 | B2 * | 10/2012 | Shmunk | H04R 29/00 381/59 |
| 8,311,248 | B2 * | 11/2012 | Bai | H04R 31/00 381/190 |
| 8,391,498 | B2 | 3/2013 | Potard | |
| 8,538,040 | B2 | 9/2013 | Kirn | |
| 8,548,184 | B2 | 10/2013 | Werner et al. | |
| 8,577,047 | B2 | 11/2013 | Gautama | |
| 8,712,065 | B2 | 4/2014 | Solgaard et al. | |
| 8,938,084 | B2 | 1/2015 | Arai | |
| 9,042,561 | B2 | 5/2015 | Gautama | |
| 9,130,527 | B2 | 9/2015 | Potard | |
| 9,154,101 | B2 | 10/2015 | Dhuyvetter | |
| 9,161,126 | B2 | 10/2015 | Su et al. | |
| 9,374,634 | B2 | 6/2016 | Macours et al. | |
| 9,432,771 | B2 | 8/2016 | Oyetunji | |
| 9,553,554 | B2 | 1/2017 | Kimura et al. | |
| 9,578,416 | B2 | 2/2017 | Gautama | |
| 9,635,454 | B2 | 4/2017 | Larrien | |
| 9,661,428 | B2 | 5/2017 | Holladay et al. | |
| 9,693,148 | B1 | 6/2017 | Lopez et al. | |
| 9,813,812 | B2 | 11/2017 | Berthelsen et al. | |
| 9,837,971 | B2 | 12/2017 | Luo et al. | |
| 9,883,305 | B2 | 1/2018 | Risberg | |
| 9,900,690 | B2 | 2/2018 | Risberg et al. | |
| 9,967,652 | B2 | 5/2018 | Baird et al. | |
| 9,980,068 | B2 | 5/2018 | Berthelsen et al. | |
| 9,992,571 | B2 | 6/2018 | Hu | |
| 10,219,090 | B2 | 2/2019 | Adams et al. | |
| 2002/0141098 | A1 | 10/2002 | Schlager | |
| 2003/0076875 | A1 | 4/2003 | Oates | |
| 2004/0028242 | A1 | 2/2004 | Kitamura | |
| 2005/0122166 | A1 | 6/2005 | Premakanthan et al. | |
| 2006/0274904 | A1 | 12/2006 | Lashkari | |
| 2007/0098190 | A1 | 5/2007 | Song et al. | |
| 2008/0175397 | A1 | 7/2008 | Holman et al. | |
| 2009/0180636 | A1 | 7/2009 | Su et al. | |
| 2010/0092004 | A1 | 4/2010 | Kuze | |
| 2012/0179456 | A1 | 7/2012 | Ryu et al. | |
| 2012/0203526 | A1 | 8/2012 | Bai et al. | |
| 2012/0288118 | A1 | 11/2012 | Gautama et al. | |
| 2012/0289809 | A1 | 11/2012 | Kaib et al. | |
| 2013/0094657 | A1 | 4/2013 | Brammer et al. | |
| 2014/0051483 | A1 | 2/2014 | Schoerkmaier | |
| 2014/0254827 | A1 | 9/2014 | Bailey et al. | |
| 2014/0286500 | A1 | 9/2014 | Iwamoto et al. | |
| 2015/0010168 | A1 | 1/2015 | Cheng et al. | |
| 2015/0010171 | A1 | 1/2015 | Pernici et al. | |
| 2015/0208175 | A1 | 7/2015 | Pinkerton et al. | |
| 2015/0281844 | A1 | 10/2015 | Stabile | |
| 2015/0319529 | A1 * | 11/2015 | Klippel | H04R 3/007 381/55 |
| 2016/0134982 | A1 | 5/2016 | Iyer | |
| 2016/0360331 | A1 | 12/2016 | Yeh | |
| 2016/0366515 | A1 | 12/2016 | Mendes et al. | |
| 2016/0373858 | A1 | 12/2016 | Lawrence et al. | |
| 2017/0055067 | A1 | 2/2017 | Moro et al. | |
| 2017/0188150 | A1 | 6/2017 | Brunet et al. | |
| 2017/0272045 | A1 | 9/2017 | Chadha | |
| 2017/0280240 | A1 * | 9/2017 | Hu | H04R 3/02 |
| 2017/0318388 | A1 | 11/2017 | Risberg et al. | |
| 2017/0325019 | A1 | 11/2017 | Bezzola et al. | |
| 2017/0345438 | A1 | 11/2017 | Thyssen | |
| 2018/0014120 | A1 | 1/2018 | Lawrence et al. | |
| 2018/0034430 | A1 | 2/2018 | Ahmed et al. | |
| 2018/0192192 | A1 | 7/2018 | Brunet et al. | |
| 2018/0206049 | A1 | 7/2018 | Wendell et al. | |
| 2019/0222939 | A1 | 7/2019 | Brunet et al. | |
| 2020/0005349 | A1 | 2/2020 | Lazar et al. | |
| 2020/0077180 | A1 | 3/2020 | Bezzola | |
| 2020/0083853 | A1 | 3/2020 | Li et al. | |

FOREIGN PATENT DOCUMENTS

| | | | |
|---|---|---|---|
| EP | 1799013 | A1 | 2/2010 |
| EP | 2369852 | A1 | 9/2011 |
| EP | 3079375 | A1 | 10/2016 |
| JP | 3433342 | B2 | 8/2003 |
| JP | 2004312141 | A | 11/2004 |
| JP | 2005129977 | A | 5/2005 |
| JP | 2007060648 | A | 3/2007 |
| JP | 2007081815 | A | 3/2007 |
| JP | 2015082754 | A | 4/2015 |
| JP | 2015084499 | A | 4/2015 |
| JP | 6182869 | B2 | 8/2017 |
| KR | 10-2005002384 | A | 3/2005 |
| KR | 10-20130001162 | | 1/2013 |
| KR | 10-20140097874 | A | 8/2014 |
| KR | 101445186 | B1 | 10/2014 |
| WO | 2014045123 | A | 3/2014 |
| WO | 2015143127 | A | 9/2015 |
| WO | 2015191691 | A1 | 12/2015 |
| WO | 2017088876 | A2 | 6/2017 |

OTHER PUBLICATIONS

ProSoundWeb, "Harman Unveils JBL 3 Series Mk II Powered Studio Monitors," Jan. 2018, pp. 1-4, EH Publishing, United States, downloaded at: https://www.prosoundweb.com/channels/recording/harman-unveils-jbl-3-series-mkii-powered-studio-monitors/.

U.S. Supplemental Notice of Allowability for U.S. Appl. No. 15/835,245 dated Jul. 15, 2019.

U.S. Notice of Allowance for U.S. Appl. No. 15/873,530 dated Jul. 18, 2019.

International Search Report dated Jun. 21, 2019 for International Application PCT/KR2019/002741 from Korean Property Intellectual Office, pp. 1-3, Republic of Korea.

U.S. Supplemental Notice of Allowability for U.S. Appl. No. 15/835,245 dated Aug. 28, 2019.

U.S. Notice of Allowability for U.S. Appl. No. 15/873,530 dated Aug. 28, 2019.

U.S. Notice of Allowability for U.S. Appl. No. 15/873,530 dated Sep. 9, 2019.

U.S. Notice of Allowance for U.S. Appl. No. 16/057,711 dated Sep. 17, 2019.

U.S. Corrected Notice of Allowability for U.S. Appl. No. 15/391,633 dated Dec. 12, 2019.

U.S. Notice of Allowance for U.S. Appl. No. 15/391,633 dated Sep. 18, 2019.

U.S. Supplemental Notice of Allowability for U.S. Appl. No. 15/835,245 dated Oct. 1, 2019.

U.S. Corrected Notice of Allowability for U.S. Appl. No. 15/873,530 dated Oct. 18, 2019.

U.S. Corrected Notice of Allowability for U.S. Appl. No. 15/873,530 dated Nov. 12, 2019.

European Office Action dated Nov. 15, 2019 for European Application No. 16882101.5 from European Patent Office, pp. 1-6, Munich, Germany.

Chinese Office Action dated Dec. 5, 2019 for Chinese Patent Application No. 201680076647.X from Chinese Patent Office, pp. 1-21, Beijing, China (English-language translation included pp. 1-14).

(56) References Cited

OTHER PUBLICATIONS

Extended European Search Report dated Nov. 21, 2019 for European Application No. 18736189.4 from European Patent Office, pp. 1-7, Munich, Germany.
Schurer, H. et al., "Theoretical and experimental comparison of three methods for compensation of electrodynamic transducer nonlinearity.", Journal of the Audio Engineering Society, Sep. 1, 1998, vol. 46, No. 9, pp. 723-740, The Netherlands.
Hu, Y. et al, "Effects of the Cone and Edge on the Acoustic Characteristics of a Cone Loudspeaker", Advances in Acoustics and Vibration, May 21, 2017, 12 pp., v. 2017, Hindawi, Egypt.
Thomsen, S. et. al., "Design and Analysis of a Flatness-Based Control Approach for Speed Control of Drive Systems with Elastic Couplings and Uncertain Loads," Proceedings of the 2011—14th European Conference (EPE 2011), Aug. 30-Sep. 1, 2011, pp. 1-10, IEEE Press, United States.
Fliess, M. et al., "Flatness and Defect of Nonlinear Systems: Introductory Theory and Examples", International Journal of Control, Jun. 1995, pp. 1327-1361, vol. 61, Taylor & Francis, United Kingdom.
Papazoglou, N. et al., "Linearisation par Asservissement d'unhaut-parleur electrodynamique: approche par les Systemes Hamiltoniens a Ports", Memoire De Fin D Etude M2R SAR Parcourt ATIAM, pp. 1-52, Aug. 11, 2014.
International Search Report and Written Opinion dated Mar. 31, 2017 for International Application PCT/KR2016/015435 from Korean Intellectual Property Office, pp. 1-12, Republic of Korea.
International Search Report and Written Opinion dated Apr. 20, 2018 for International Application PCT/KR2018/000016 from Korean Intellectual Property Office, pp. 1-5, Republic of Korea.
Salvatti, A. et al., "Maximizing performance from loudspeaker ports," Journal of the Audio Engineering Society, Jan./Feb. 2002, pp. 19-45, v. 50, No. 1/2, United States.
U.S. Non-Final Office Action for U.S. Appl. No. 15/391,633 dated Mar. 28, 2019.
U.S. Non-Final Office Action for U.S. Appl. No. 15/835,245 dated Jun. 14, 2018.
U.S. Final Office Action for U.S. Appl. No. 15/835,245 dated Jan. 10, 2019.
U.S. Advisory Action for U.S. Appl. No. 15/835,245 dated Apr. 11, 2019.
U.S. Notice of Allowance for U.S. Appl. No. 16/057,711 dated Apr. 2, 2019.
International Search Report and Written Opinion dated Apr. 29, 2019 for International Application PCT/KR2019/000702 from Korean Intellectual Property Office, pp. 1-10, Republic of Korea.
U.S. Notice of Allowance for U.S. Appl. No. 15/835,245 dated May 6, 2019.
International Search Report and Written Opinion dated Dec. 23, 2019 for International Application PCT/KR2019/011591 from Korean Intellectual Property Office, pp. 1-9, Republic of Korea.
International Search Report and Written Opinion dated Dec. 23, 2019 for International Application PCT/KR2019/011200 from Korean Intellectual Property Office, pp. 1-12, Republic of Korea.
U.S. Non-Final Office Action for U.S. Appl. No. 16/391,081 dated Mar. 31, 2020.

* cited by examiner

300

440

450

ENERGY LIMITER FOR LOUDSPEAKER PROTECTION

CROSS-REFERENCE TO RELATED APPLICATIONS

This application claims the priority benefit of U.S. Provisional Patent Application Ser. No. 62/640,448, filed Mar. 8, 2018, all incorporated herein by reference in their entirety

TECHNICAL FIELD

One or more embodiments relate generally to loudspeakers, and in particular, a method and system for limiting energy stored in a loudspeaker.

BACKGROUND

A loudspeaker produces sound when connected to an integrated amplifier, a television (TV) set, a radio, a music player, an electronic sound producing device (e.g., a smartphone, a computer), a video player, etc.

SUMMARY

One embodiment provides a method comprising determining a potential energy in a loudspeaker, a kinetic energy in the loudspeaker, and an electrical energy in the loudspeaker based on a physical model of the loudspeaker. The method further comprises determining a total energy stored in the loudspeaker based on the potential energy, the kinetic energy, and the electrical energy. The method further comprises determining a maximum potential displacement of a diaphragm of a speaker driver of the loudspeaker based on the total energy, and limiting the total energy stored in the loudspeaker by attenuating a source signal for reproduction via the loudspeaker. An actual displacement of the diaphragm during the reproduction of the source signal is controlled based on the attenuated source signal.

Another embodiment provides a system for limiting energy in a loudspeaker. The system comprises a voltage source amplifier connected to the loudspeaker and a limiter connected to the voltage source amplifier. The limiter is configured to determine a potential energy in the loudspeaker, a kinetic energy in the loudspeaker, and an electrical energy in the loudspeaker based on a physical model of the loudspeaker. The limiter is further configured to determine a total energy stored in the loudspeaker based on the potential energy, the kinetic energy, and the electrical energy. The limiter is further configured to determine a maximum potential displacement of a diaphragm of a speaker driver of the loudspeaker based on the total energy, and limit the total energy stored in the loudspeaker by attenuating a voltage of a source signal for reproduction via the loudspeaker. The voltage source amplifier outputs the attenuated voltage to drive the speaker driver. An actual displacement of the diaphragm during the reproduction of the source signal is controlled based on the attenuated voltage.

One embodiment provides a loudspeaker device comprising a speaker driver including a diaphragm, a voltage source amplifier connected to the speaker driver, and a limiter connected to the voltage source amplifier. The limiter is configured to determine a potential energy in the loudspeaker, a kinetic energy in the loudspeaker, and an electrical energy in the loudspeaker based on a physical model of the loudspeaker. The limiter is further configured to determine a total energy stored in the loudspeaker based on the potential energy, the kinetic energy, and the electrical energy. The limiter is further configured to determine a maximum potential displacement of a diaphragm of a speaker driver of the loudspeaker based on the total energy, and limit the total energy stored in the loudspeaker by attenuating a voltage of a source signal for reproduction via the loudspeaker. The voltage source amplifier outputs the attenuated voltage to drive the speaker driver. An actual displacement of the diaphragm during the reproduction of the source signal is controlled based on the attenuated voltage.

These and other features, aspects and advantages of the one or more embodiments will become understood with reference to the following description, appended claims, and accompanying figures.

DETAILED DESCRIPTION

Figure 1:
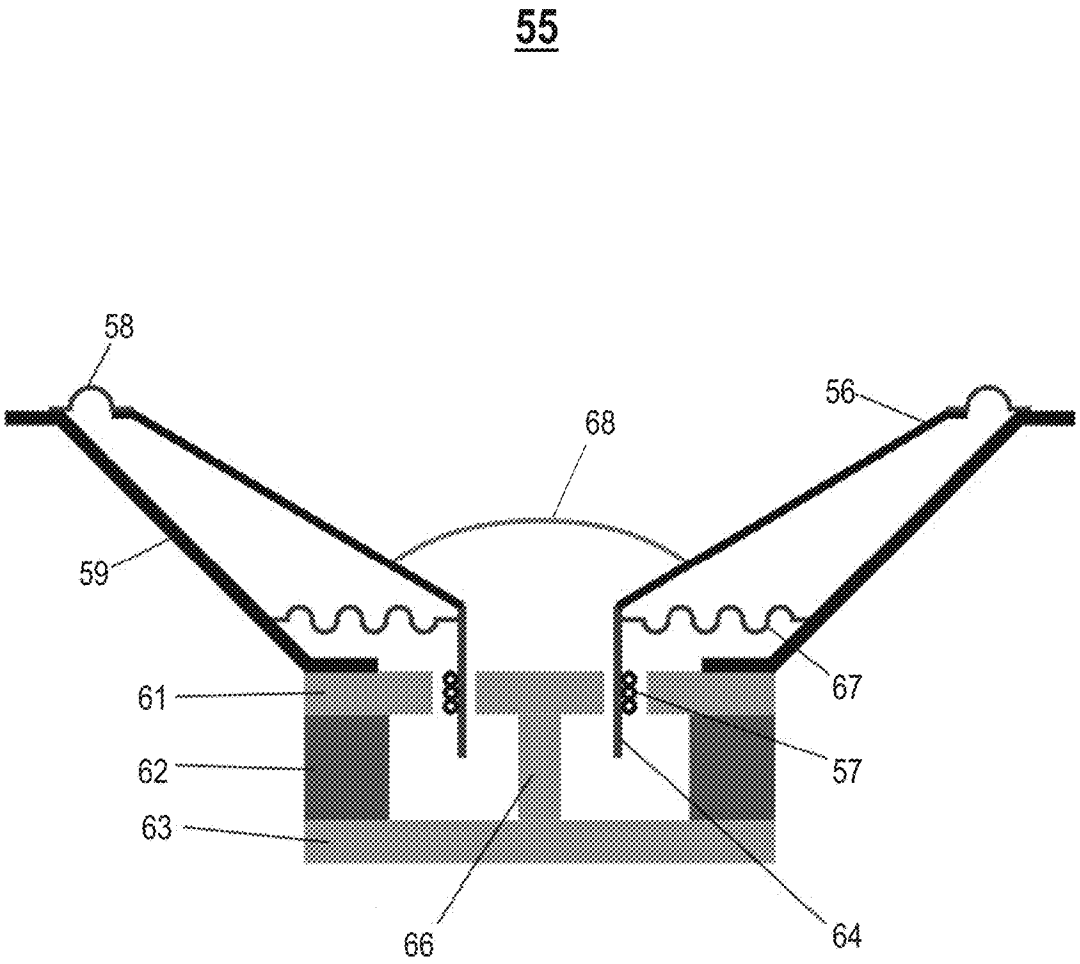
FIG. 1 illustrates a cross section of an example speaker driver.

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

One or more embodiments relate generally to loudspeakers, and in particular, a method and system for limiting energy stored in a loudspeaker. One embodiment provides a method comprising determining a potential energy in a loudspeaker, a kinetic energy in the loudspeaker, and an electrical energy in the loudspeaker based on a physical model of the loudspeaker. The method further comprises determining a total energy stored in the loudspeaker based on the potential energy, the kinetic energy, and the electrical energy. The method further comprises determining a maximum potential displacement of a diaphragm of a speaker driver of the loudspeaker based on the total energy, and limiting the total energy stored in the loudspeaker by attenuating a source signal for reproduction via the loudspeaker. An actual displacement of the diaphragm during the reproduction of the source signal is controlled based on the attenuated source signal.

Another embodiment provides a system for limiting energy in a loudspeaker. The system comprises a voltage source amplifier connected to the loudspeaker and a limiter connected to the voltage source amplifier. The limiter is configured to determine a potential energy in the loudspeaker, a kinetic energy in the loudspeaker, and an electrical energy in the loudspeaker based on a physical model of the loudspeaker. The limiter is further configured to determine a total energy stored in the loudspeaker based on the potential energy, the kinetic energy, and the electrical energy. The limiter is further configured to determine a maximum potential displacement of a diaphragm of a speaker driver of the loudspeaker based on the total energy, and limit the total energy stored in the loudspeaker by attenuating a voltage of a source signal for reproduction via the loudspeaker. The voltage source amplifier outputs the attenuated voltage to drive the speaker driver. An actual displacement of the diaphragm during the reproduction of the source signal is controlled based on the attenuated voltage.

One embodiment provides a loudspeaker device comprising a speaker driver including a diaphragm, a voltage source amplifier connected to the speaker driver, and a limiter connected to the voltage source amplifier. The limiter is configured to determine a potential energy in the loudspeaker, a kinetic energy in the loudspeaker, and an electrical energy in the loudspeaker based on a physical model of the loudspeaker. The limiter is further configured to determine a total energy stored in the loudspeaker based on the potential energy, the kinetic energy, and the electrical energy. The limiter is further configured to determine a maximum potential displacement of a diaphragm of a speaker driver of the loudspeaker based on the total energy, and limit the total energy stored in the loudspeaker by attenuating a voltage of a source signal for reproduction via the loudspeaker. The voltage source amplifier outputs the attenuated voltage to drive the speaker driver. An actual displacement of the diaphragm during the reproduction of the source signal is controlled based on the attenuated voltage.

For expository purposes, the terms "loudspeaker", "loudspeaker device" and "loudspeaker system" may be used interchangeably in this specification.

For expository purposes, the terms "displacement" and "excursion" may be used interchangeably in this specification.

A conventional loudspeaker is nonlinear by design and produces harmonics, intermodulation components, and modulation noise. Nonlinear audio distortion (i.e., audible distortion) impairs sound quality of audio produced by the loudspeaker (e.g., audio quality and speech intelligibility). In recent times, industrial design constraints often require loudspeaker systems to be smaller-sized for portability and compactness. Such design constraints, however, trade size and portability for sound quality, resulting in increased audio distortion. As such, an anti-distortion system for reducing/removing audio distortion is needed, in particular for obtaining a more pronounced/bigger bass sound from smaller-sized loudspeaker systems.

A loudspeaker device includes at least one speaker driver for reproducing sound. FIG. 1 illustrates a cross section of an example speaker driver 55. The speaker driver 55 comprises one or more moving components, such as a diaphragm 56 (e.g., a cone-shaped diaphragm), a driver voice coil 57, a former 64, and a protective cap 68 (e.g., a dome-shaped dust cap). The speaker driver 55 further comprises one or more of the following components: (1) a surround roll 58 (e.g., suspension roll), (2) a basket 59, (3) a top plate 61, (4) a magnet 62, (5) a bottom plate 63, (6) a pole piece 66, and (7) a spider 67.

Figure 2:
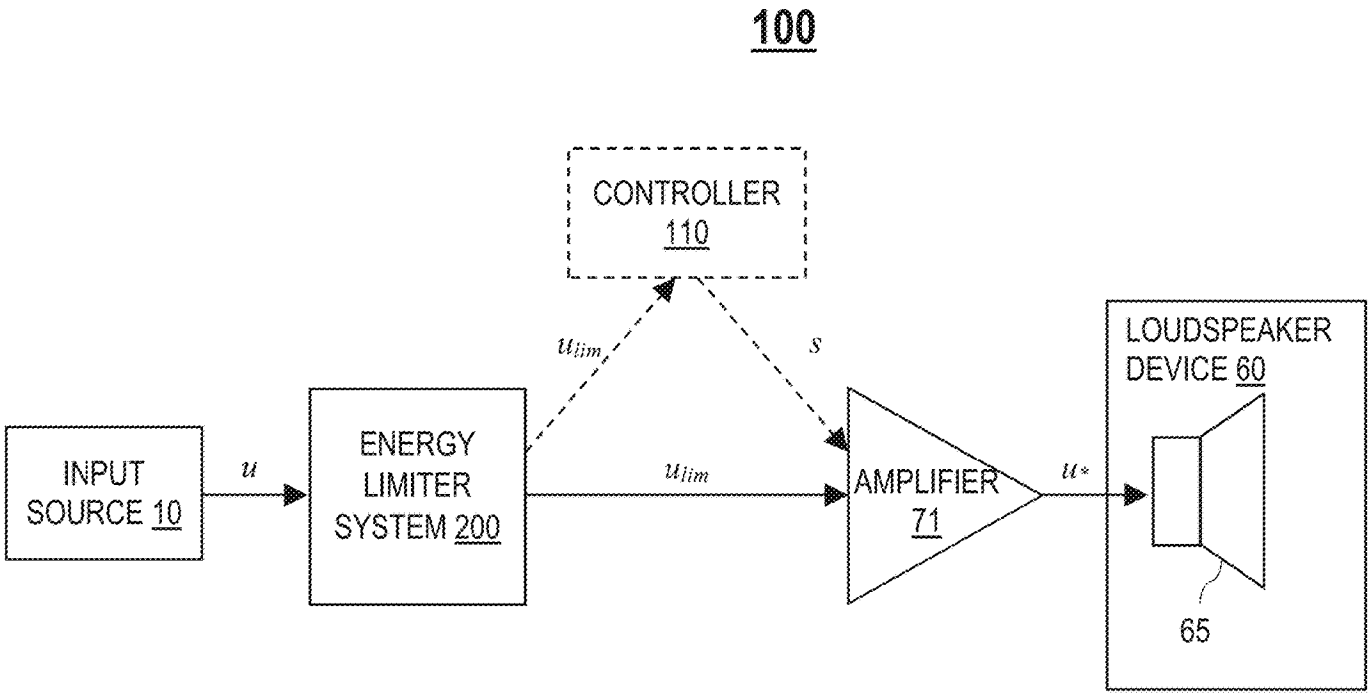
FIG. 2 illustrates an example loudspeaker system, in accordance with an embodiment.

FIG. 2 illustrates an example loudspeaker system 100, in accordance with an embodiment. The loudspeaker system 100 comprises a loudspeaker device 60 including a speaker driver 65 for reproducing sound. The loudspeaker device 60 may be any type of loudspeaker device such as, but not limited to, a sealed-box loudspeaker, a vented-box loudspeaker, a passive-radiator loudspeaker, a loudspeaker array, etc. The speaker driver 65 may be any type of speaker driver such as, but not limited to, a forward-facing speaker driver, an upward-facing speaker driver, a downward-facing speaker driver, etc. In one embodiment, the speaker driver 55 in FIG. 1 is an example implementation of the speaker driver 65. The speaker driver 65 comprises one or more moving components, such as a diaphragm 56 (FIG. 1) and a driver voice coil 57 (FIG. 1).

The loudspeaker system 100 comprises an energy limiter system 200 configured to monitor and control energy stored in the loudspeaker device 60 to predict and limit and/or compress displacement of the one or more moving components during audio reproduction. In one embodiment, the system 200 is configured to receive a source signal (e.g., an input signal such as an input audio signal) from an input source 10 for audio reproduction via the loudspeaker device 60. In one embodiment, the energy limiter system 200 is configured to receive a source signal from different types of input sources 10. Examples of different types of input sources 10 include, but are not limited to, a mobile electronic device (e.g., a smartphone, a laptop, a tablet, etc.), a content playback device (e.g., a television, a radio, a computer, a music player such as a CD player, a video player such as a DVD player, a turntable, etc.), or an audio receiver, etc.

Let u generally denote an input voltage of the source signal. As described in detail later herein, the energy limiter system 200 is configured to: (1) based on a physical model of the loudspeaker device 60, determine a total energy E stored in the loudspeaker device 60, (2) determine a maximum potential displacement (e.g., predicted maximum cone displacement) x of the one or more moving components, and (3) determine, in real-time, an amount of attenuation to apply to the input voltage u to produce an energy and displacement limiting voltage ("limiting voltage") $u_{lim}$ that limits and/or compresses the total energy E stored in the loudspeaker device 60 and in turn limits and/or compresses an actual displacement (e.g., actual cone displacement) of the one or more moving components within a predetermined range of safe displacement.

Figure 4A:
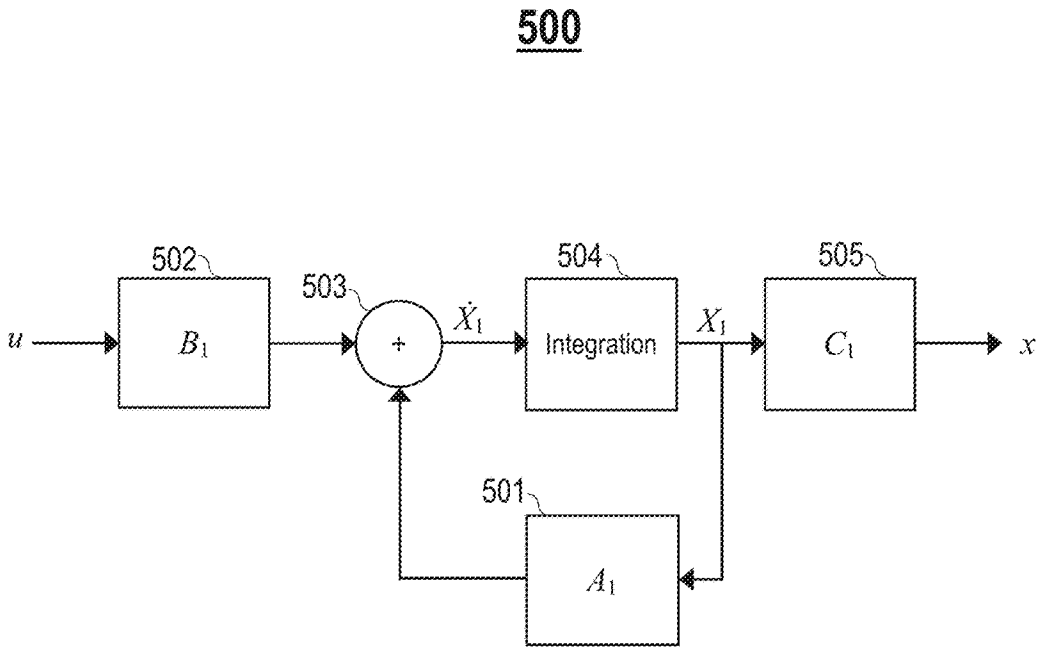
FIG. 4A illustrates an example linear system representing a linear state-space model of the loudspeaker device in FIG. 2.
Figure 4B:
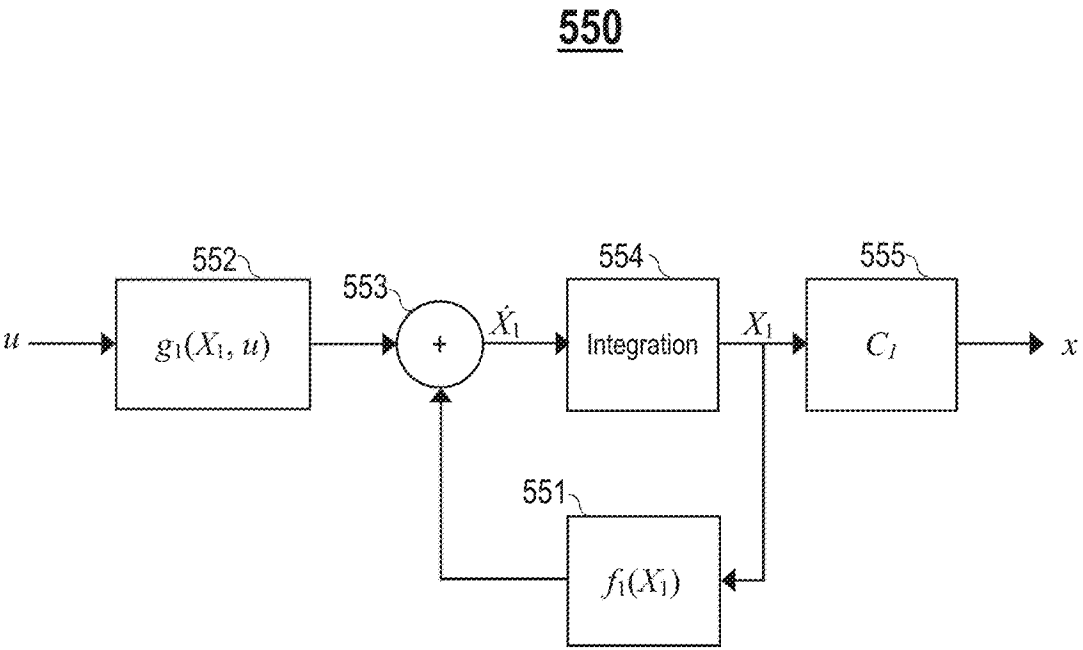
FIG. 4B illustrates an example nonlinear system representing a nonlinear state-space physical model of the loudspeaker device in FIG. 2.

A physical model of the loudspeaker device 60 may be based on one or more loudspeaker parameters for the loudspeaker device 60. In one embodiment, a physical model of the loudspeaker device 60 utilized by the energy limiter system 200 is a linear model (e.g., a linear state-space model as shown in FIG. 4A). In another embodiment, a physical model of the loudspeaker device 60 utilized by the energy limiter system 200 is a nonlinear model (e.g., a nonlinear state-space model as shown in FIG. 4B).

In one embodiment, the loudspeaker system 100 comprises a voltage source amplifier 71 connected to the loudspeaker device 60 and the energy limiter system 200. The voltage source amplifier 71 is a power amplifier configured to output (i.e., apply or produce), for each sampling time t, an actual voltage (i.e., applied voltage) u* based on a limiting voltage $u_{lim}$ determined by the energy limiter system 200 at the sampling time t. The limiting voltage $u_{lim}$ controls the voltage source amplifier 71, directing the voltage source amplifier 71 to output an amount of voltage that is substantially the same as the limiting voltage $u_{lim}$. The speaker driver 65 is driven by the actual voltage u* output by the voltage source amplifier 71, thereby amplifying the source signal for audio reproduction via the loudspeaker device 60. Therefore, the loudspeaker system 100 controls actual displacement of the one or more moving components (i.e., cone displacement/motion of the one or more moving components) during the audio reproduction of the source signal by performing voltage correction based on the limiting voltage $u_{lim}$.

In one embodiment, the system 100 comprises an optional controller 110 for linear or nonlinear control of the loudspeaker device 60. For example, in one embodiment, the controller 110 is a nonlinear control system configured to provide correction of nonlinear audio distortion by predistorting voltage to the speaker driver 65. The controller 110 is configured to receive, as input, a limiting voltage $u_{lim}$ at a sampling time t (e.g., from the system 200), and generate and transmit a control voltage signal s specifying a target voltage that produces a target displacement at the sampling time t. The control voltage signal s can be any type of signal such as, but not limited to, a current, a voltage, a digital signal, an analog signal, etc. In one embodiment, the voltage source amplifier 71 is configured to output an actual voltage u* at a sampling time t based on a control voltage signal s from the controller 110, wherein the control voltage signal s directs the voltage source amplifier 71 to output an amount of voltage that is substantially the same as a target voltage included in the control voltage signal s for the sampling time t.

The energy limiter system 200 facilitates a higher level of audio reproduction, with improved sound quality, and additional control and protection of the loudspeaker device 60. The energy limiter system 200 maximizes bass output and sound loudness. The energy limiter system 200 facilitates smooth control of energy stored in the loudspeaker device 60 to preserve audio quality. The energy limiter system 200 utilizes a time-domain algorithm without any change in frequency content or spectral balance (i.e., frequency filtering).

As described in detail later herein, the energy limiter system 200 is configured to counter audio distortion during the reproduction of the source signal via the speaker driver 65 by calculating a limiting voltage $u_{lim}$ at each instant/sampling time t based on an instantaneous position of the one or more moving components, wherein an actual voltage output by the voltage source amplifier 71 is substantially equal to the limiting voltage $u_{lim}$.

Reproducing bass via the loudspeaker device 60 requires larger excursions of the one or more moving components to achieve the same loudness. However, excessive excursion of the one or more moving components can cause damage to the speaker driver 65. The energy limiter system 200 allows the one or more moving components to achieve the largest possible excursion without exceeding safe limits (i.e., the predetermined range of safe displacement), thus maximizing bass output.

In one embodiment, the loudspeaker system 100 may be integrated in different types of electrodynamic transducers with a broad range of applications such as, but not limited to, the following: computers, televisions (TVs), smart devices (e.g., smart TVs, smart phones, etc.), soundbars, subwoofers, wireless and portable speakers, mobile phones, car speakers, etc.

Figure 3:
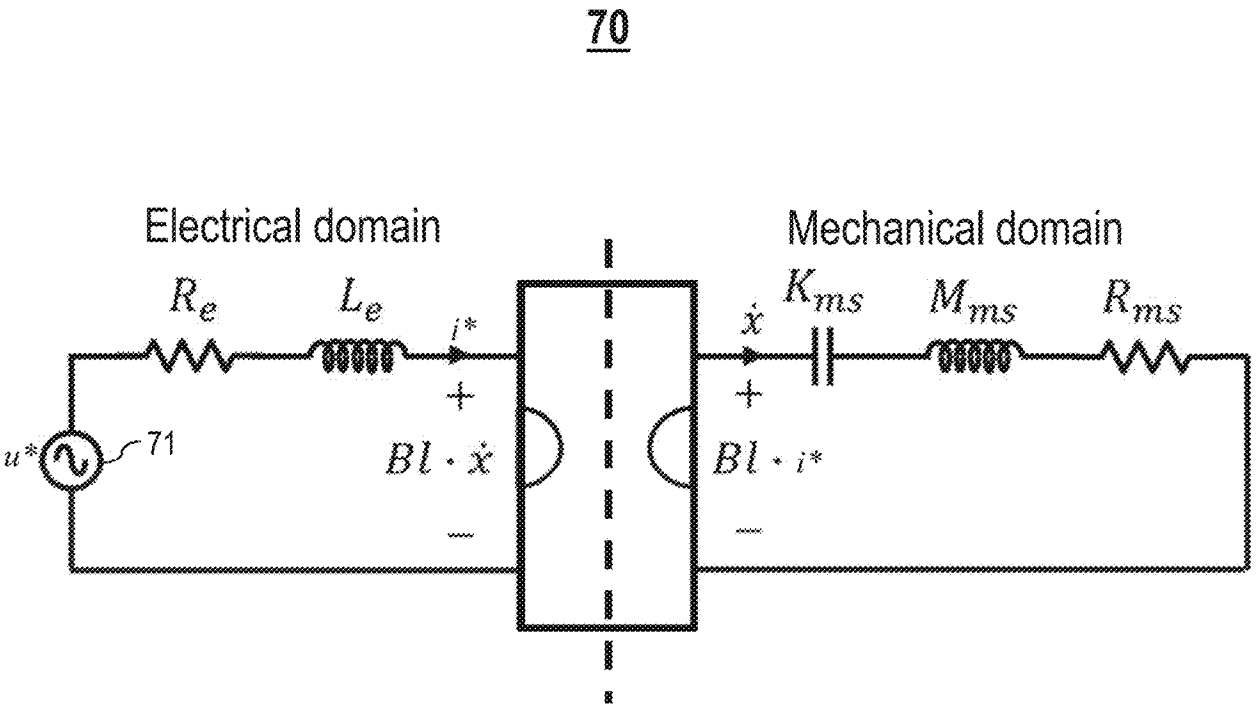
FIG. 3 illustrates an example electroacoustic model for a loudspeaker device in FIG. 2.

FIG. 3 illustrates an example electroacoustic model 70 for a loudspeaker device 60 (FIG. 2) driven by a voltage source amplifier 71. One or more loudspeaker parameters (i.e., loudspeaker characteristics) for the loudspeaker device 60 may be classified into one of the following domains: an electrical domain or a mechanical domain. In the electrical domain, examples of different loudspeaker parameters include, but are not limited to, the following: (1) an applied voltage u* from the voltage source amplifier 71 for driving a speaker driver 65 of the loudspeaker device 60, (2) an electrical resistance $R_e$ of a driver voice coil 57 of the speaker driver 65, (3) a current i* flowing through the driver voice coil 57 as a result of the applied voltage u*, (4) an inductance $L_e$ of the driver voice coil 57, and (5) a back electromagnetic force (back EMF) $Bl\cdot\dot{x}$ resulting from the motion of the driver voice coil 57 in the magnetic field of the motor structure (i.e., driver voice coil 57, top plate 61, magnet 62, bottom plate 63, and pole piece 66) of the speaker driver 65, wherein the back-EMF $Bl\cdot\dot{x}$ represents a product of a force factor Bl of the motor structure and a velocity $\dot{x}$ of one or more moving components of the speaker driver 65 (e.g., a diaphragm 56, the driver voice coil 57, and/or the former 64).

In the mechanical domain, examples of different loudspeaker parameters include, but are not limited to, the following: (1) the velocity $\dot{x}$ of the one or more moving components of the speaker driver 65, (2) a mechanical mass $M_{ms}$ of the one or more moving components (i.e., moving mass) and air load, (3) a mechanical resistance $R_{ms}$ representing the mechanical losses of the speaker driver 65, (4) a stiffness factor $K_{ms}$ of the suspension (i.e., surround roll 58, spider 67, plus air load) of the speaker driver 65, and (5) a mechanical force $Bl\cdot i^*$ applied on the one or more moving components, wherein the mechanical force $Bl\cdot i^*$ represents a product of the force factor Bl of the motor structure and the current i* flowing through the driver voice coil 57.

The state of a loudspeaker device 60 at each instant may be described using each of the following: (1) a displacement x of the one or more moving components of the speaker driver 65, (2) a velocity $\dot{x}$ of the one or more moving components of the speaker driver 65, and (3) a current i flowing through the driver voice coil 57. Let $X_1(t)$ generally denote a vector representing a state ("state vector representation") of the loudspeaker device 60 at a sampling time t. The state vector representation $X_1(t)$ may be defined in accordance with equation (1) provided below:

$$X_1(t)=[x,\dot{x},i]^T \quad (1).$$

For expository purposes, the terms $X_1(t)$ and $X_1$ are used interchangeably in this specification.

As described in detail later herein below, the system 200 determines, at each sampling time t, an estimated displacement x of the one or more moving components at the sampling time t, an estimated velocity $\dot{x}$ of the one or more moving components at the sampling time t, and an estimated current i flowing through the driver voice coil 57 at a sampling time t based on a physical model of the loudspeaker device 60, such as a linear model (e.g., a linear state-space model as shown in FIG. 4A) or a nonlinear model (e.g., a nonlinear state-space model as shown in FIG. 4B). The physical model may be based on one or more loudspeaker parameters for the loudspeaker device 60.

FIG. 4A illustrates an example linear system 500 representing a linear state-space model of the loudspeaker device 60. The linear system 500 may be utilized to determine an estimated displacement x of one or more moving components (e.g., a diaphragm 56 and/or a driver voice coil 57) of the speaker driver 65 based on a state vector representation $X_1$ of the loudspeaker device 60 and an input voltage u of a source signal for reproduction via the loudspeaker device 60.

Let $\dot{X}_1$ generally denote a time derivative (i.e., rate of change) of the state vector representation $X_1$ of the loudspeaker device 60 ("state vector rate of change"). The state vector rate of change $\dot{X}_1$ may be defined in accordance with a differential equation (2) provided below:

$$\dot{X}_1=A_1X_1+B_1u \quad (2).$$

Let $A_1$, $B_1$, and $C_1$ denote constant parameter matrices. The constant parameter matrices $A_1$, $B_1$, and $C_1$ may be represented in accordance with equations (3)-(5) provided below:

$$A_1=\begin{bmatrix} 0 & 1 & 0 \\ -K_{ms}/M_{ms} & -R_{ms}/M_{ms} & Bl/M_{ms} \\ 0 & -Bl/L_e & -R_e/L_e \end{bmatrix}, \quad (3)$$

$$B_1=\begin{bmatrix} 0 \\ 0 \\ 1/L_e \end{bmatrix}, \text{ and} \quad (4)$$

$$C_1=[1\ \ 0\ \ 0]. \quad (5)$$

An estimated displacement x of the one or more moving components of the speaker driver 65 may be computed in accordance with equation (6) provided below:

$$x=C_1X_1 \quad (6).$$

Determining an estimated displacement x of the one or more moving components utilizing the linear system 500 involves performing a set of computations that are based on equations (2)-(6) provided above. The linear system 500 may utilize one or more of the following components to perform the set of computations: (1) a first multiplication unit 501 configured to determine a product term $A_1X_1$ by multiplying the constant parameter matrix $A_1$ with the state vector representation $X_1$, (2) a second multiplication unit 502 configured to determine a product term $B_1u$ by multiplying the constant parameter matrix $B_1$ with the input voltage u, (3) an addition unit 503 configured to determine the state vector rate of change $\dot{X}_1$ by adding the product terms $A_1X_1$ and Bu in accordance with equation (2) provided above, (4) an integration unit 504 configured to determine the state vector representation $X_1$ by integrating the state vector rate of change $\dot{X}_1$ in the time domain, and (5) a third multiplication unit 505 configured to determine the estimated displacement x by multiplying the constant parameter matrix $C_1$ with the state vector representation $X_1$ in accordance with equation (6) provided above.

The system representation 500 in FIG. 4A is a linear system that receives an input voltage u as an input and provides an estimated displacement x as an output.

FIG. 4B illustrates an example nonlinear system 550 representing a nonlinear state-space physical model of the loudspeaker device 60. The nonlinear system 550 may be utilized to determine an estimated displacement x of one or more moving components (e.g., a diaphragm 56 and/or a driver voice coil 57) of the speaker driver 65 based on a state vector representation $X_1$ of the loudspeaker device 60 and an input voltage u of a source signal for reproduction via the loudspeaker device 60.

Let $g_1(X_1, u)$ and $f_1(X_1)$ generally denote nonlinear functions that are based on the state vector representation $X_1$ of the loudspeaker device 60 and one or more large signal loudspeaker parameters for the loudspeaker device 60. The nonlinear functions $g_1(X_1, u)$ and $f_1(X_1)$ may be represented in accordance with equations (7)-(8) provided below:

$$g_1(X_1, u)=[0\ \ 0\ \ u/L_e(x)]^T, \text{ and} \quad (7)$$

$$f_1(X_1)=\begin{bmatrix} \dot{x} \\ (1/M_{ms})(-K_{ms}(x)x-R_{ms}(\dot{x})\cdot\dot{x}+ \\ Bl(x)\cdot i+(i^2/2)(dL_e/dx)) \\ (1/L_e(x))(-Bl(x)\cdot\dot{x}-R_e(T)\cdot i-(dL_e/dx)\dot{x}\cdot i) \end{bmatrix}. \quad (8)$$

Let $C_1$ generally denote a constant parameter matrix. The constant parameter matrix $C_1$ may be represented in accordance with equation (9) provided below:

$$C_1=[1\ \ 0\ \ 0]. \quad (9)$$

Let $\dot{X}_1$ generally denote a time derivative (i.e., rate of change) of the state vector representation $X_1$ of the loudspeaker device 60 ("state vector rate of change"). The state vector rate of change $\dot{X}_1$ may be defined in accordance with a differential equation (10) provided below:

$$\dot{X}_1=g_1(X_1,u)+f_1(X_1) \quad (10).$$

An estimated displacement x of the one or more moving components of the speaker driver 65 may be computed in accordance with equation (11) provided below:

$$x=C_1X_1 \quad (11).$$

Determining an estimated displacement x of the one or more moving components utilizing the nonlinear system 550 involves performing a set of computations that are based on equations (7)-(11) provided above. The nonlinear system 550 may utilize one or more of the following components to perform the set of computations: (1) a first computation unit 551 configured to compute the nonlinear function $f_1(X_1)$ in accordance with equation (8) provided above, (2) a second computation unit 552 configured to compute the nonlinear function $g_1(X_1, u)$ in accordance with equation (7) provided above, (3) an addition unit 553 configured to determine the state vector rate of change $\dot{X}_1$ by adding the nonlinear functions $g_1(X_1, u)$ and $f_1(X_1)$ in accordance with equation (10) provided above, (4) an integration unit 554 configured to determine the state vector representation $X_1$ by integrating the state vector rate of change $\dot{X}_1$ in the time-domain, and (5) a multiplication unit 555 configured to determine the estimated displacement x by multiplying the constant parameter matrix $C_1$ with the state vector representation $X_1$ in accordance with equation (11) provided above.

The system representation 550 in FIG. 4B is a nonlinear system that receives an input voltage u as an input and provides an estimated displacement x as an output.

Let E generally denote total energy stored in the loudspeaker device 60. At any sampling time t, total energy E stored in the loudspeaker device 60 may be represented as a sum of potential energy, kinetic energy, and electrical energy in the loudspeaker device 60, as expressed by equation (12) provided below:

$$E=\tfrac{1}{2}K_{ms}x^2+\tfrac{1}{2}M_{ms}\dot{x}^2+\tfrac{1}{2}L_e i^2 \quad (12),$$

wherein $\tfrac{1}{2}K_{ms}x^2$ denotes the potential energy in the loudspeaker device 60, $\tfrac{1}{2}M_{ms}\dot{x}^2$ denotes the kinetic energy in the loudspeaker device 60, and $\tfrac{1}{2}L_e i^2$ denotes the electrical energy in the loudspeaker device 60.

Let $x_{sup}$ generally denote a maximum potential displacement (e.g., predicted maximum cone displacement) of the one or more moving components of the speaker driver 65, wherein the maximum potential displacement $x_{sup}$ can be either a positive value ($+x_{sup}$) or a negative value ($-x_{sup}$). The maximum potential displacement $x_{sup}$ results when all the energy E stored in the loudspeaker device 60 is concentrated in the suspension, i.e., the total energy E stored in the loudspeaker device 60 is equal to the potential energy in the loudspeaker device 60, as represented by equation (13) provided below:

$$E=\tfrac{1}{2}K_{ms}x_{sup}^2 \quad (13)$$

Based on equation (13) provided above, the maximum potential displacement $x_{sup}$ may be represented in accordance with equation (14) provided below:

$$|x_{sup}| = \sqrt{\frac{2E}{K_{ms}}}, \quad (14)$$

wherein $|x_{sup}|$ denotes an absolute value of the maximum potential displacement $x_{sup}$ and represents a maximum potential displacement envelope (i.e., a predetermined range of maximum potential displacement $[-x_{sup}, x_{sup}]$ of the one or more moving components of the speaker driver 65).

Let $x_{lim}$ generally denote a predetermined displacement limit (i.e., maximum desired displacement) for safe displacement of the one or more moving components of the speaker driver 65, and let $[-x_{lim}, x_{lim}]$ generally denote a predetermined range of safe displacement of the one or more moving components of the speaker driver 65. The system 200 ensures that the maximum potential displacement $x_{sup}$ does not exceed the predetermined displacement limit $x_{lim}$. To limit an actual displacement (e.g., actual cone displacement) of the one or more moving components of the speaker driver 65 within the predetermined range of safe displacement $[-x_{lim}, x_{lim}]$, total energy E stored in the loudspeaker device 60 must be limited to satisfy a constraint represented by expression (15) provided below:

$$E\leq\tfrac{1}{2}K_{ms}x_{lim}^2 \quad (15).$$

Let $$\frac{dE}{dt}$$

generally denote total power in the loudspeaker device 60, wherein the total power $$\frac{dE}{dt}$$

is a time derivative (i.e., rate of change) of total energy E stored in the loudspeaker device 60. The total power $$\frac{dE}{dt}$$

in the loudspeaker device 60 may be represented in accordance with a differential equation (16) provided below:

$$\frac{dE}{dt} = -R_{ms}\dot{x}^2 - R_e i^2 + iu. \quad (16)$$

Without electrical input (i.e., input voltage u=0), the total power $$\frac{dE}{dt}$$

in the loudspeaker device 60 is negative due to mechanical and electrical losses, and the total energy E stored in the loudspeaker device 60 decreases to zero (i.e., stability).

Figure 5:
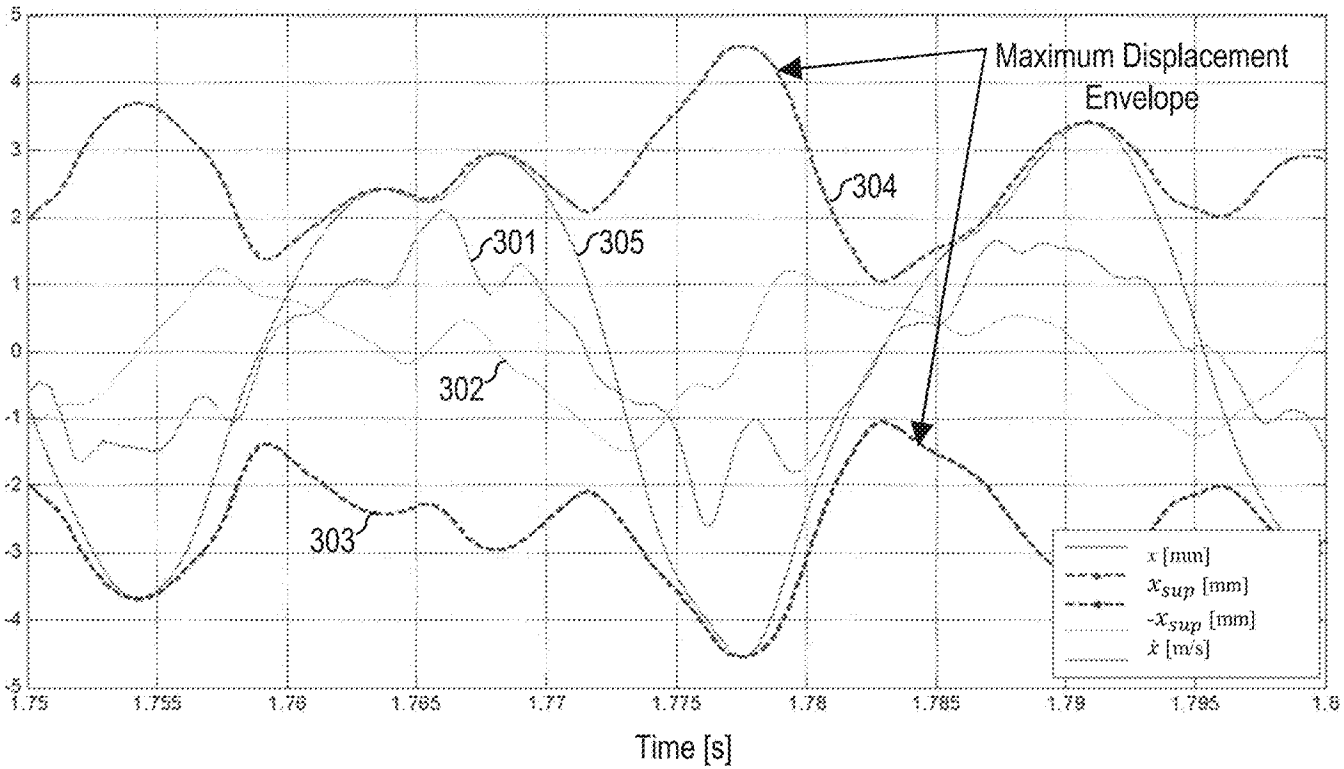
FIG. 5 is an example graph illustrating different loudspeaker parameters for the loudspeaker device in FIG. 2 during audio reproduction.

FIG. 5 is an example graph 300 illustrating different loudspeaker parameters for a loudspeaker device 60 during audio reproduction. A horizontal axis of the graph 300 represents time in seconds (s). The graph 300 comprises each of the following: (1) a first curve 301 representing a current i flowing through a driver voice coil 57 of a speaker driver 65 of the loudspeaker device 60 in Amperes (A), (2) a second curve 302 representing velocity $\dot{x}$ of one or more moving components (e.g., a diaphragm 56 and/or the driver voice coil 57) of the speaker driver 65 in meters per second (m/s), (3) a third curve 303 representing a negative value of maximum potential displacement $-x_{sup}$ of the one or more moving components of the speaker driver 65 in millimeters (mm), (4) a fourth curve 304 representing a positive value of maximum potential displacement $x_{sup}$ of the one or more moving components of the speaker driver 65 in mm, and (5) a fifth curve 305 representing displacement x of the one or more moving components of the speaker driver 65 in mm. As shown in FIG. 5, the displacement x of the one or moving components of the speaker driver 65 reaches $\pm x_{sup}$ ("maximum displacement envelope") when the velocity $\dot{x}$ of the one or more moving components of the speaker driver 65 crosses zero. When the velocity $\dot{x}$ of the one or more moving components of the speaker driver 65 crosses zero, electrical energy in the loudspeaker device 60 is negligible compared to mechanical energies in the loudspeaker device 60.

Figure 6:
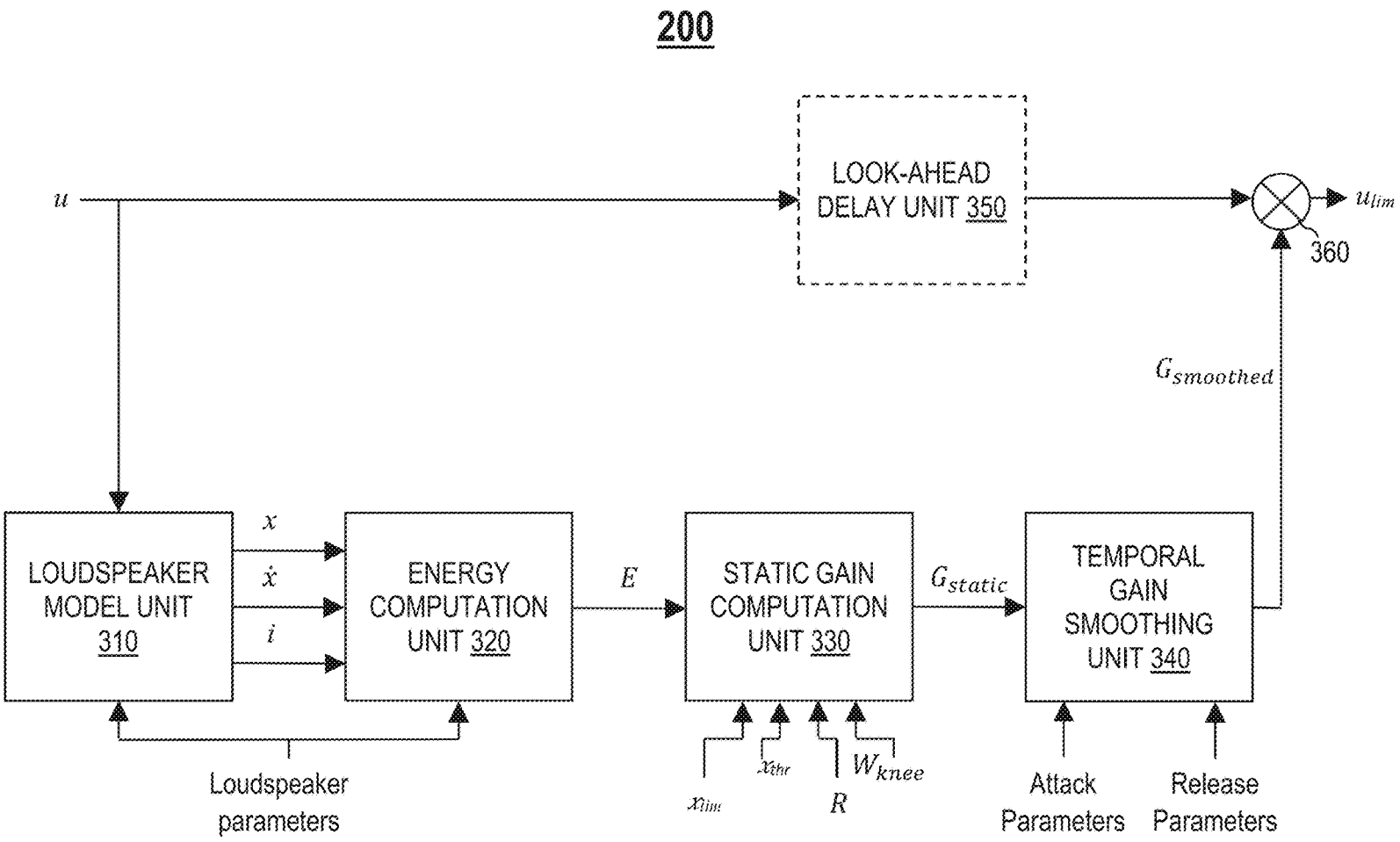
FIG. 6 illustrates an example energy limiter system, in accordance to an embodiment.

FIG. 6 illustrates an example energy limiter system 200, in accordance to an embodiment. As described in detail later herein, the system 200 provides a limiter and/or a compressor for limiting and/or compressing total energy stored in a loudspeaker device 60, which in turn limits and/or compresses displacement x of one or more moving components of a speaker driver 65 (e.g., a diaphragm 56, the driver voice coil 57, and/or the former 64) of the loudspeaker device 60.

In one embodiment, the system 200 comprises a loudspeaker model unit 310 configured to receive, as inputs, an input voltage u at a sampling time t and one or more loudspeaker parameters for the loudspeaker device 60 (e.g., small-signal loudspeaker parameters for the loudspeaker device 60, such as mechanical mass $M_{ms}$, inductance $L_e$, and stiffness factor $K_{ms}$). Based on the inputs received and a physical model of the loudspeaker device 60 (e.g., a linear state-space model as shown in FIG. 4A or a nonlinear state-space model as shown in FIG. 4B), the loudspeaker model unit 310 is configured to recursively determine each of the following: an estimated displacement x of the one or more moving components of the speaker driver 65 at the sampling time t, an estimated velocity $\dot{x}$ of the one or more moving components of the speaker driver 65 at the sampling time t, and an estimated current i flowing through a driver voice coil 57 of the speaker driver 65 at the sampling time t.

In one embodiment, the system 200 comprises an energy computation unit 320 configured to receive, as inputs, an estimated displacement x of the one or more moving components of the speaker driver 65 at a sampling time t (e.g., from the loudspeaker model unit 310), an estimated velocity $\dot{x}$ of the one or more moving components of the speaker driver 65 at the sampling time t (e.g., from the loudspeaker model unit 310), an estimated current i flowing through the driver voice coil 57 at the sampling time t (e.g., from the loudspeaker model unit 310), and one or more loudspeaker parameters for the loudspeaker device 60 (e.g., small-signal loudspeaker parameters for the loudspeaker device 60, such as mechanical mass $M_{ms}$, inductance $L_e$, and stiffness factor $K_{ms}$). Based on the inputs received, the energy computation unit 320 is configured to determine total energy E stored in the loudspeaker device 60 at the sampling time t.

In one embodiment, the energy computation unit 320 is configured to determine total energy E stored in the loudspeaker device 60 by: (1) computing, based on the inputs received, potential energy in the loudspeaker device 60, kinetic energy in the loudspeaker device 60, and electrical energy in the loudspeaker device 60, and (2) computing a sum of the potential energy, the kinetic energy, and the electrical energy, wherein the total energy E stored in the loudspeaker device 60 factors into account the sum computed.

In one embodiment, the energy computation unit 320 is configured to determine total energy E stored in the loudspeaker device 60 in accordance with equation (17) provided below:

$$E=10\log_{10}[\tfrac{1}{2}K_{ms}x^2+\tfrac{1}{2}M_{ms}\dot{x}^2+\tfrac{1}{2}L_e i^2] \quad (17).$$

In another embodiment, the energy computation unit 320 is configured to determine total energy E stored in the loudspeaker device 60 based on a predictive model trained to learn dynamics of energy.

In one embodiment, the system 200 comprises a static gain computation unit 330 configured to receive, as inputs, an estimated total energy E stored in the loudspeaker device 60 at a sampling time t (e.g., from the energy computation unit 320) and a set of displacement parameters indicative of a desired displacement behavior of the one or more moving components of the speaker driver 65. In one embodiment, the set of displacement parameters comprise, but is not limited to, one or more of the following displacement parameters: a predetermined displacement limit $x_{lim}$, a predetermined displacement compression threshold $x_{thr}$, a predetermined compression ratio R, or a predetermined soft knee width $W_{knee}$. Based on the inputs received, the static gain computation unit 330 is configured to determine an instantaneous gain $G_{static}$ to apply at the sampling time t to limit and/or compress the displacement x of the one or more moving components of the speaker driver 65 at the sampling time t.

Let $E_{lim}$ generally denote a predetermined energy limit, and let $E_{thr}$ generally denote a predetermined energy compression threshold. In one embodiment, the system 200 operates as a limiter (i.e., the limiter is enabled) to limit total energy E stored in the loudspeaker 60 based on a predetermined energy limit $E_{lim}$. In one embodiment, the system 200 operates as a compressor (i.e., the compressor is enabled) to compress total energy E stored in the loudspeaker 60 based on a predetermined energy compression threshold $E_{thr}$. In one embodiment, the system 200 is operable as one of the following: a limiter only, a compressor only, or both a limiter and a compressor.

In one embodiment, the static gain computation unit 330 is configured to convert one or more displacement parameters to one or more corresponding energy parameters, such as a predetermined energy limit $E_{lim}$ and/or a predetermined energy compression threshold $E_{thr}$. For example, in one embodiment, if the limiter is enabled, the static gain computation unit 330 is configured to convert a predetermined displacement limit $x_{lim}$ received as an input to a predetermined energy limit $E_{lim}$ in accordance with equation (18) provided below:

$$E_{lim}=10\log_{10}[\tfrac{1}{2}K_{ms}x_{lim}^2] \quad (18).$$

As another example, in one embodiment, if the compressor is enabled, the static gain computation unit 330 is configured to convert a predetermined displacement compression threshold $x_{thr}$ received as an input to a predetermined energy compression threshold $E_{thr}$ in accordance with equation (19) provided below:

$$E_{thr}=10\log_{10}[\tfrac{1}{2}K_{ms}x_{thr}^2] \quad (19).$$

In one embodiment, if only the limiter is enabled, the static gain computation unit 330 determines an instantaneous gain $G_{static}$ to apply at a sampling time t to limit a displacement x of the one or more moving components of the speaker driver 65 at the sampling time tin accordance with equations (20)-(21) provided below:

$$G_{static}=0 \text{ if } E\leq E_{lim} \quad (20), \text{ and}$$

$$G_{static}=E_{lim}-E \text{ if } E_{lim}<E \quad (21).$$

In one embodiment, if both the limiter and the compressor are enabled, the static gain computation unit 330 determines an instantaneous gain $G_{static}$ to apply at a sampling time t to limit and compress a displacement x of the one or more moving components of the speaker driver 65 at the sampling time tin accordance with equations (22)-(25) provided below:

$$G_{static} = 0 \text{ if } E \le E_{thr} - \frac{W_{knee}}{2}, \tag{22}$$

$$G_{static} = \frac{\left(E - E_{thr} + \frac{W_{knee}}{2}\right)^2 \left(\frac{1}{R} - 1\right)}{2W_{knee}} \text{ if } E_{thr} - \frac{W_{knee}}{2} < E \le E_{thr} + \frac{W_{knee}}{2}, \tag{23}$$

$$G_{static} = (E - E_{thr}) \left(\frac{1}{R} - 1\right) \text{ if } E_{thr} + \frac{W_{knee}}{2} < E \le E_{lim}, \text{ and} \tag{24}$$

$$G_{static} = E_{lim} - E \text{ if } E_{lim} < E. \tag{25}$$

In one embodiment, the system 200 comprises a temporal gain smoothing unit 340 configured to implement temporal gain smoothing (i.e., gain attenuation). Specifically, the temporal gain smoothing unit 340 is configured to: (1) receive, as inputs, an instantaneous gain $G_{static}$ at a sampling time t (e.g., from the static gain computation unit 330), an optional set of attack parameters for reducing the gain $G_{static}$ (i.e., attack), and an optional set of release parameters for increasing the gain $G_{static}$ (i.e., release), and (2) apply a smoothing algorithm to the gain $G_{static}$ to reduce or prevent rapid changes in the gain $G_{static}$ that can adversely affect perceived sound quality, resulting in a smoothed gain $G_{smoothed}$.

In one embodiment, the temporal gain smoothing unit 340 is configured to apply any type of smoothing algorithm. For example, as described in detail later herein, in one embodiment, the smoothing algorithm applied involves adjusting the gain $G_{static}$ exponentially utilizing the set of attack parameters and/or the set of release parameters.

In one embodiment, the system 200 comprises an optional look-ahead delay unit 350 configured to: (1) receive an input voltage u at a sampling time t, and (2) implement a look-ahead delay by delaying the input voltage u for a predetermined amount of time (e.g., 20 ms) to allow for temporal gain smoothing (e.g., implemented by the temporal gain smoothing unit 340). Delaying the input voltage u allows for gain attenuation before total energy E stored in the loudspeaker device 60 exceeds a predetermined energy compression threshold $E_{thr}$. In one embodiment, the system 200 minimizes or eliminates the look-ahead delay by estimating/predicting a state of the loudspeaker device 60, thereby removing the need for the look-ahead delay unit 350.

In one embodiment, the system 200 comprises a component 360 configured to receive, as inputs, a smoothed gain $G_{smoothed}$ to apply at a sampling time t (e.g., from the temporal gain smoothing unit 340), and an input voltage u at the sampling time t (e.g., from the look-ahead delay unit 350 if look-ahead delay is implemented). The component 360 is configured to attenuate the input voltage u by applying the smoothed gain $G_{smoothed}$ to the input voltage u, resulting in a limiting voltage $u_{lim}$ at the sampling time t that limits and/or compresses total energy E stored in the loudspeaker device 60 at the sampling time t and in turn limits and/or compresses an actual displacement (e.g., actual cone displacement) of the one or more moving components of the speaker driver 65 to within a predetermined range of safe displacement $[-x_{lim}, x_{lim}]$ at the sampling time t.

Figure 7A:
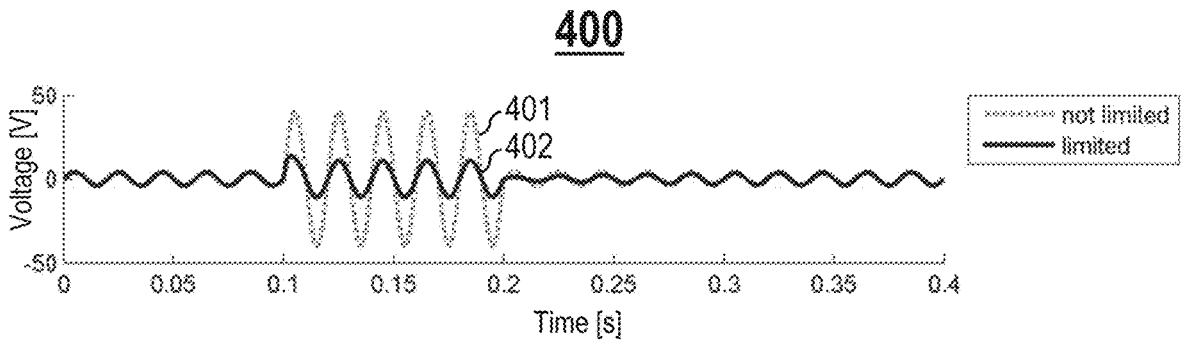
FIG. 7A is an example graph comparing differences in voltage as result of enabling a limiter provided by the energy limiter system, in accordance with an embodiment.

FIG. 7A is an example graph 400 comparing differences in voltage as result of enabling the limiter, in accordance with an embodiment. A horizontal axis of the graph 400 represents time in s. A vertical axis of the graph 400 represents voltage in V. The graph 400 comprises a first curve 401 representing an actual voltage driving the speaker driver 65 when the limiter is not enabled (i.e., actual voltage u* is substantially about input voltage u), and a second curve 402 representing an actual voltage driving the speaker driver 65 when the limiter is enabled (i.e., actual voltage u* is substantially about limiting voltage $u_{lim}$).

Figure 7B:
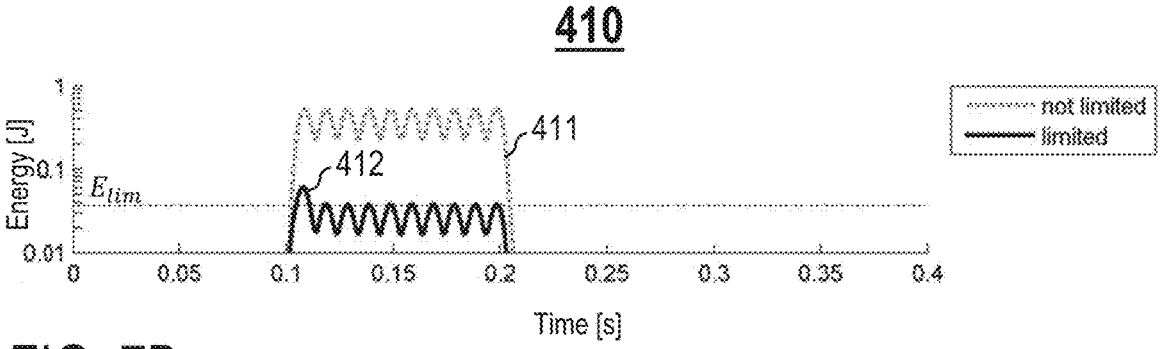
FIG. 7B is an example graph illustrating total energy as result of enabling the limiter, in accordance with an embodiment.

FIG. 7B is an example graph 410 illustrating total energy as result of enabling the limiter, in accordance with an embodiment. A horizontal axis of the graph 410 represents time in s. A vertical axis of the graph 410 represents energy in Joules (J). The graph 410 comprises a first curve 411 representing total energy stored in the loudspeaker device 60 when the limiter is not enabled, and a second curve 412 representing total energy stored in the loudspeaker device 60 when the limiter is enabled. If the limiter is enabled, the system 200 adjusts the limiting voltage $u_{lim}$ to keep the total energy E stored in the loudspeaker device 60 below a predetermined energy limit $E_{lim}$, as shown in FIG. 7B.

Figure 7C:
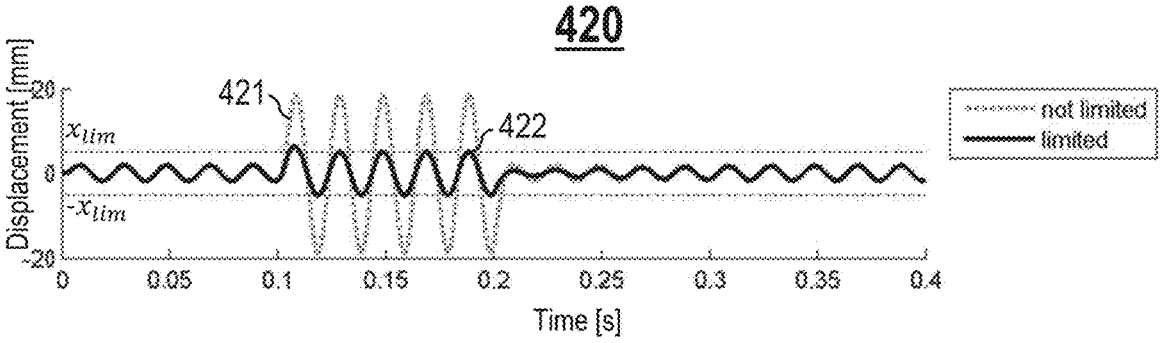
FIG. 7C is an example graph comparing differences in displacement as result of enabling the limiter, in accordance with an embodiment.

FIG. 7C is an example graph 420 comparing differences in displacement as result of enabling the limiter, in accordance with an embodiment. A horizontal axis of the graph 420 represents time in s. A vertical axis of the graph 420 represents displacement in mm. The graph 420 comprises a first curve 421 representing an actual displacement of the one or more moving components of the speaker driver 65 when the limiter is not enabled, and a second curve 422 representing an actual displacement of the one or more moving components of the speaker driver 65 when the limiter is enabled. If the limiter is enabled, the system 200 applies a gain that limits actual displacement of the one or more moving components of the speaker driver 65 to within a predetermined range of safe displacement $[-x_{lim}, x_{lim}]$. For example, if $x_{lim}$ is 5 mm, the system 200 with the limiter enabled applies a gain that limits the actual displacement x* of the one or more moving components of the speaker driver 65 to within a range [−5, 5], as shown in FIG. 7C.

Figure 7D:
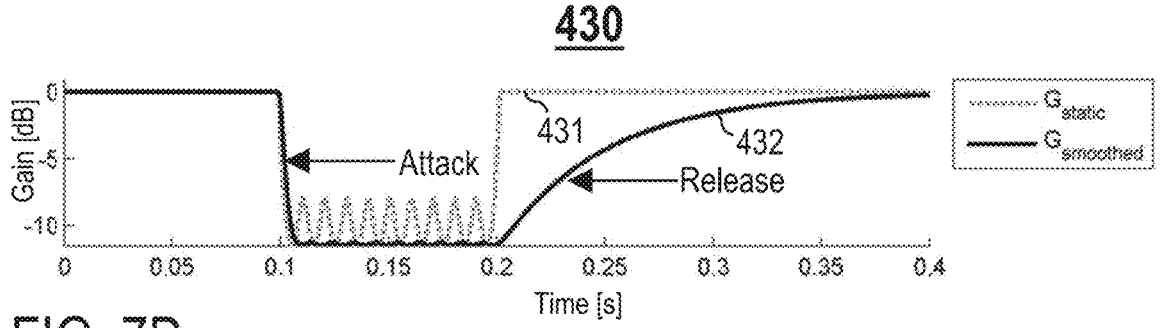
FIG. 7D is an example graph comparing static gain with smoothed gain, in accordance with an embodiment.

FIG. 7D is an example graph 430 comparing gain $G_{static}$ with smoothed gain $G_{smoothed}$, in accordance with an embodiment. A horizontal axis of the graph 430 represents time in s. A vertical axis of the graph 430 represents gain in dB. The graph 430 comprises a first curve 431 representing static gain $G_{static}$, and a second curve 432 representing smoothed gain $G_{smoothed}$. In one embodiment, the smoothing algorithm applied by the system 200 involves adjusting an instantaneous gain $G_{static}$ exponentially utilizing a set of attack parameters and/or a set of release parameters. As shown in FIG. 7D, if there is a step change in the gain $G_{static}$ from a high gain value $G_{high}$ to a low gain value $G_{low}$, the system 200 reduces the gain $G_{static}$ (i.e., attack) exponentially utilizing the set of attack parameters, resulting in a smoothed gain $G_{smoothed}$ that is represented in accordance with equation (26) provided below:

$$G_{smoothed} = (G_{high} - G_{low}) e^{-t/\tau_{attack}} + G_{low} \tag{26}$$

wherein $\tau_{attack}$ is a time constant representing an amount of time it takes for the gain $G_{static}$ to get within 36.8% of the smoothed gain $G_{smoothed}$.

As further shown in FIG. 7D, if there is a step change in the gain $G_{static}$ from the low gain value $G_{low}$ to the high gain value $G_{high}$, the system 200 increases the gain $G_{static}$ (i.e., release) exponentially utilizing the set of release parameters, resulting in a smoothed gain $G_{smoothed}$ that is represented in accordance with equation (27) provided below:

$$G_{smoothed} = (G_{high} - G_{low})(1 - e^{-t/\tau_{release}}) + G_{low} \tag{27}$$

wherein $\tau_{release}$ is a time constant representing an amount of time it takes for the gain $G_{static}$ to get within 36.8% of the smoothed gain $G_{smoothed}$.

In one embodiment, $\tau_{attack}$ is 2 ms, $\tau_{release}$ is 50 ms, and the look-ahead delay is 3 ms. In one embodiment, $\tau_{attack}$, $\tau_{release}$, and the look-ahead delay have different values for different implementations.

Figure 8:
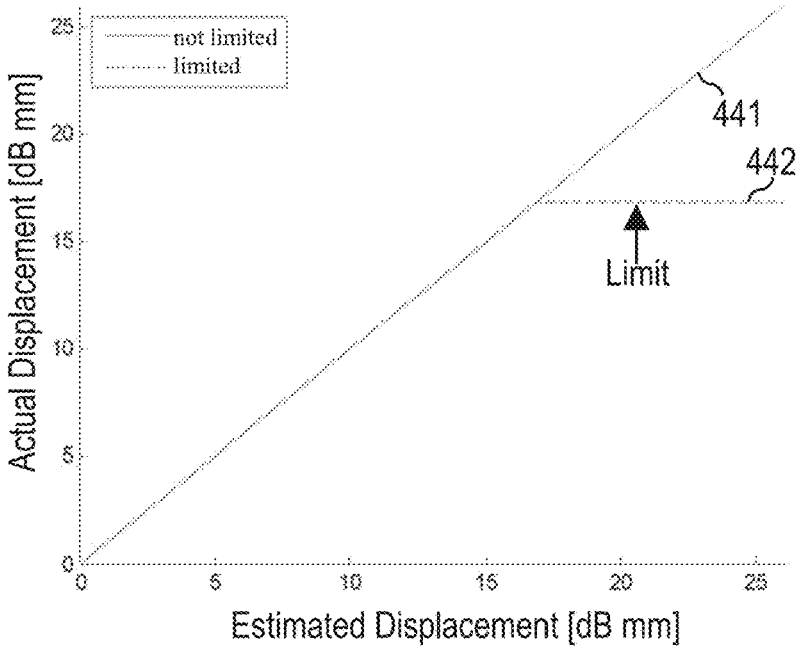
FIG. 8 is an example graph comparing displacement when only the limiter is enabled with displacement when the limiter is not enabled, in accordance with an embodiment.

FIG. 8 is an example graph 440 comparing displacement when only the limiter is enabled with displacement when the limiter is not enabled, in accordance with an embodiment. A horizontal axis of the graph 440 represents an estimated displacement of one or more moving components of a speaker driver 65 of a loudspeaker device 60 in dB mm. A vertical axis of the graph 440 represents an actual displacement of the one or more moving components of the speaker driver 65 in dB mm. The graph 440 comprises a first curve 441 representing the actual displacement of the one or more moving components of the speaker driver 65 when the limiter is not enabled, and a second curve 442 representing the actual displacement of the one or more moving components of the speaker driver 65 when only the limiter is enabled. If a predetermined displacement limit $x_{lim}$ is 16.9 dB mm (i.e., 7.0 mm), the system 200 with the limiter enabled applies an instantaneous gain that limits actual displacement of the one or more moving components of the speaker driver 65 to substantially about 16.9 dB mm, as shown in FIG. 8.

Figure 9:
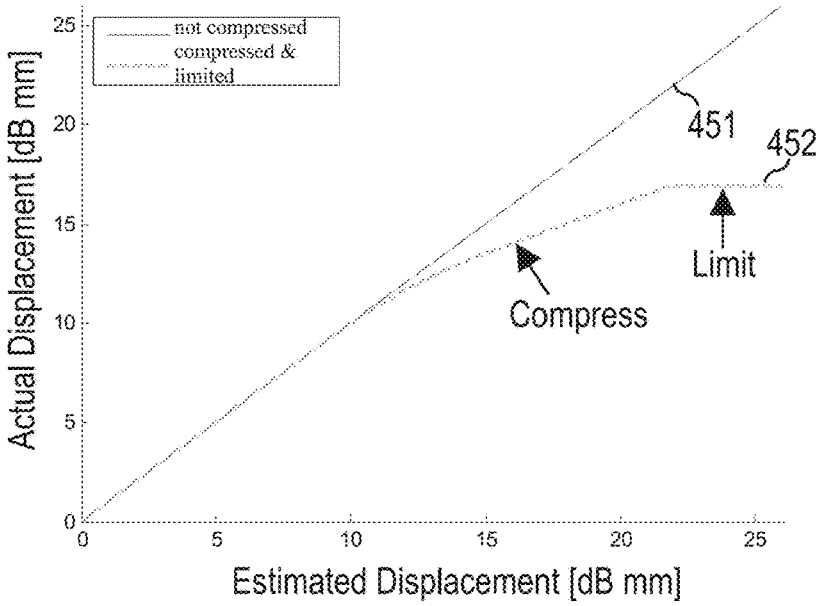
FIG. 9 is an example graph comparing displacement when both the limiter and a compressor provided by the energy limiter system are enabled with displacement when neither the limiter nor the compressor are enabled, in accordance with an embodiment.

FIG. 9 is an example graph 450 comparing displacement when both the limiter and the compressor are enabled with displacement when neither the limiter nor the compressor are enabled, in accordance with an embodiment. A horizontal axis of the graph 450 represents an estimated displacement of one or more moving components of a speaker driver 65 of a loudspeaker device 60 in dB mm. A vertical axis of the graph 450 represents an actual displacement of the one or more moving components of the speaker driver 65 in dB mm. The graph 450 comprises a first curve 451 representing the actual displacement of the one or more moving components of the speaker driver 65 when neither the limiter nor the compressor are enabled, and a second curve 452 representing the actual displacement of the one or more moving components of the speaker driver 65 when both the limiter and the compressor are enabled. If a predetermined displacement limit $x_{lim}$ is 16.9 dB mm (i.e., 7.0 mm), a predetermined displacement compression threshold $x_{thr}$ is 12.0 dB mm (i.e., 4.0 mm), a predetermined compression ratio R is 2:1, and a predetermined soft knee width $W_{knee}$ is 6 dB, the system 200 with the limiter and the compressor enabled applies an instantaneous gain that compresses actual displacement of the one or more moving components of the speaker driver 65, and then limits the actual displacement to substantially about 16.9 dB mm, as shown in FIG. 9.

Figure 10:
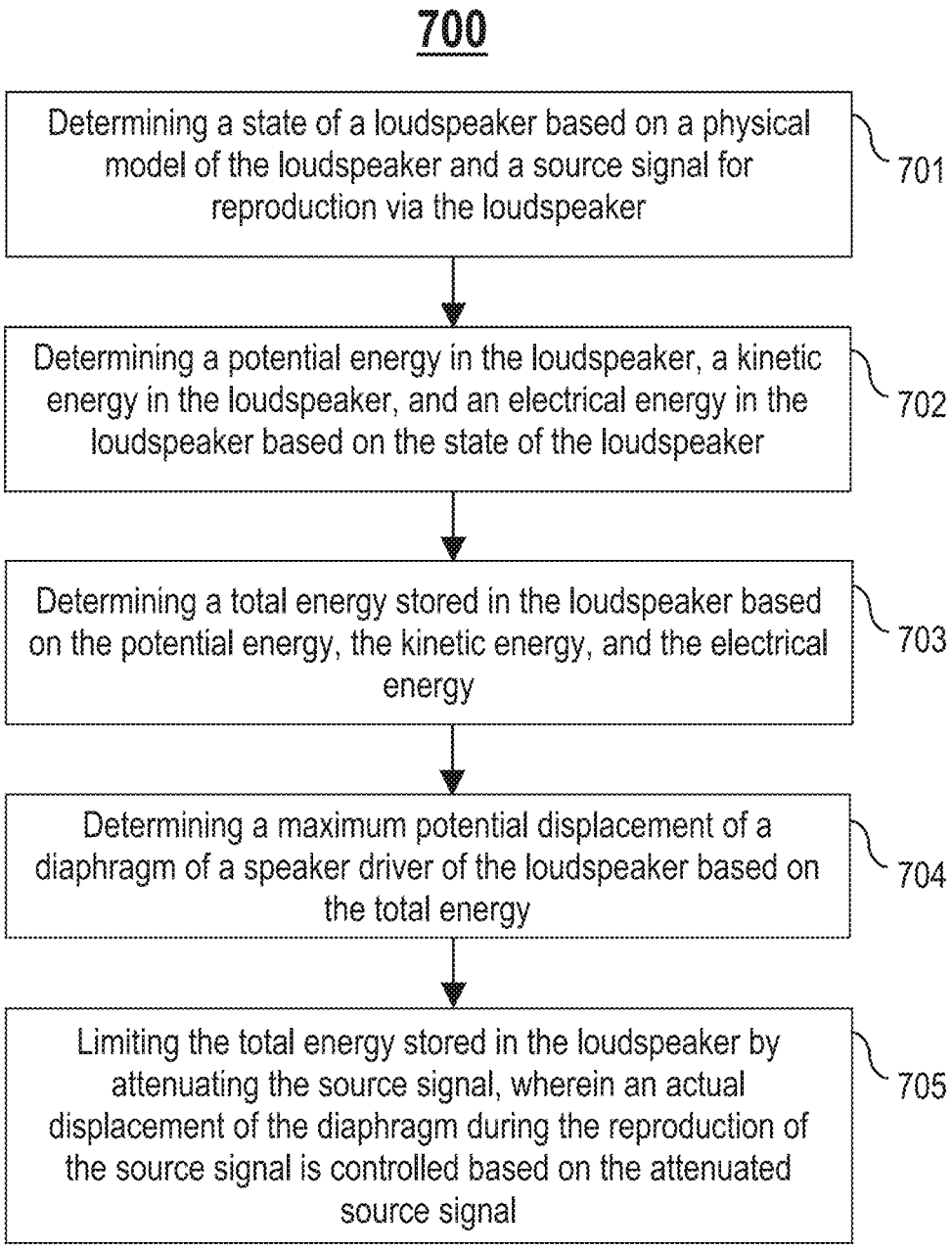
FIG. 10 is an example flowchart of a process for limiting energy in a loudspeaker, in accordance with an embodiment.

FIG. 10 is an example flowchart of a process 700 for limiting energy in a loudspeaker, in accordance with an embodiment. Process block 701 includes determining a state of a loudspeaker (e.g., loudspeaker device 60) based on a physical model of the loudspeaker (e.g., a linear state-space model as shown in FIG. 4A or a nonlinear state-space model as shown in FIG. 4B) and a source signal for reproduction via the loudspeaker. Process block 702 includes determining a potential energy in the loudspeaker, a kinetic energy in the loudspeaker, and an electrical energy in the loudspeaker based on the state of the loudspeaker. Process block 703 includes determining a total energy stored in the loudspeaker based on the potential energy, the kinetic energy, and the electrical energy. Process block 704 includes determining a maximum potential displacement of a diaphragm of a speaker driver of the loudspeaker based on the total energy. Process block 705 includes limiting the total energy stored in the loudspeaker by attenuating the source signal, wherein an actual displacement of the diaphragm during the reproduction of the source signal is controlled based on the attenuated source signal.

In one embodiment, one or more components of the energy limiter system 200, such as the loudspeaker model unit 310, the energy computation unit 320, the static gain computation unit 330, the temporal gain smoothing unit 340, the look-ahead delay unit 350, and/or the component 360, are configured to perform process blocks 701-705.

Figure 11:
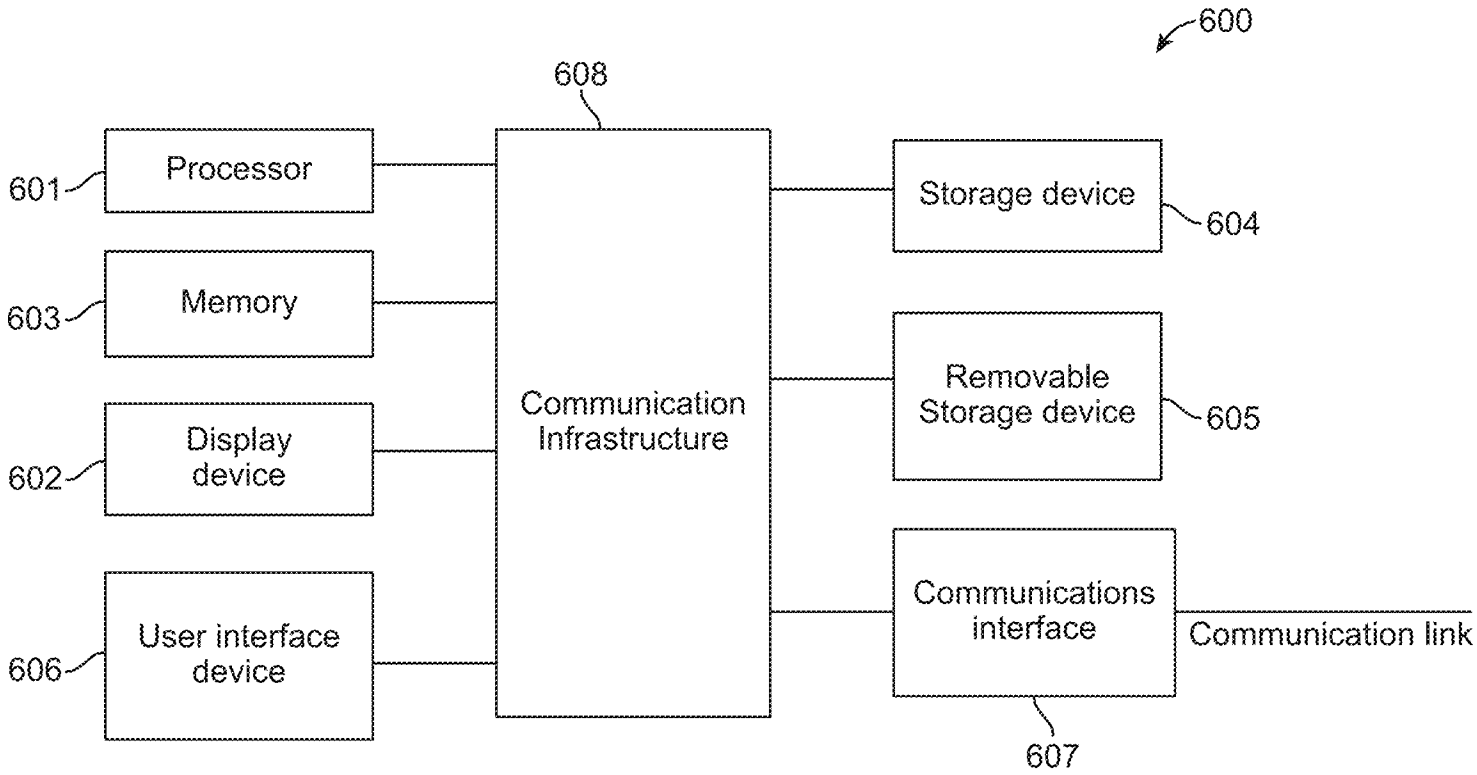
FIG. 11 is a high-level block diagram showing an information processing system comprising a computer system useful for implementing various disclosed embodiments.

FIG. 11 is a high-level block diagram showing an information processing system comprising a computer system 600 useful for implementing various disclosed embodiments. The computer system 600 includes one or more processors 601, and can further include an electronic display device 602 (for displaying video, graphics, text, and other data), a main memory 603 (e.g., random access memory (RAM)), storage device 604 (e.g., hard disk drive), removable storage device 605 (e.g., removable storage drive, removable memory module, a magnetic tape drive, optical disk drive, computer readable medium having stored therein computer software and/or data), user interface device 606 (e.g., keyboard, touch screen, keypad, pointing device), and a communication interface 607 (e.g., modem, a network interface (such as an Ethernet card), a communications port, or a PCMCIA slot and card).

The communication interface 607 allows software and data to be transferred between the computer system 600 and external devices. The nonlinear controller 600 further includes a communications infrastructure 608 (e.g., a communications bus, cross-over bar, or network) to which the aforementioned devices/modules 601 through 607 are connected.

Information transferred via the communications interface 607 may be in the form of signals such as electronic, electromagnetic, optical, or other signals capable of being received by communications interface 607, via a communication link that carries signals and may be implemented using wire or cable, fiber optics, a phone line, a cellular phone link, a radio frequency (RF) link, and/or other communication channels. Computer program instructions representing the block diagrams and/or flowcharts herein may be loaded onto a computer, programmable data processing apparatus, or processing devices to cause a series of operations performed thereon to produce a computer implemented process. In one embodiment, processing instructions for process 700 (FIG. 10) may be stored as program instructions on the memory 603, storage device 604, and/or the removable storage device 605 for execution by the processor 601.

Embodiments have been described with reference to flowchart illustrations and/or block diagrams of methods, apparatus (systems), and computer program products. In some cases, each block of such illustrations/diagrams, or combinations thereof, can be implemented by computer program instructions. The computer program instructions when provided to a processor produce a machine, such that the instructions, which executed via the processor create means for implementing the functions/operations specified in the flowchart and/or block diagram. Each block in the flowchart/block diagrams may represent a hardware and/or software module or logic. In alternative implementations, the functions noted in the blocks may occur out of the order noted in the figures, concurrently, etc.

The terms "computer program medium," "computer usable medium," "computer readable medium," and "computer program product," are used to generally refer to media such as main memory, secondary memory, removable storage drive, a hard disk installed in hard disk drive, and signals. These computer program products are means for providing software to the computer system. The computer readable medium allows the computer system to read data, instructions, messages or message packets, and other computer readable information from the computer readable medium. The computer readable medium, for example, may include non-volatile memory, such as a floppy disk, ROM, flash memory, disk drive memory, a CD-ROM, and other permanent storage. It is useful, for example, for transporting information, such as data and computer instructions, between computer systems. Computer program instructions may be stored in a computer readable medium that can direct a computer, other programmable data processing apparatuses, or other devices to function in a particular manner, such that the instructions stored in the computer readable medium produce an article of manufacture including instructions which implement the function/act specified in the flowchart and/or block diagram block(s).

As will be appreciated by one skilled in the art, aspects of the embodiments may be embodied as a system, method or computer program product. Accordingly, aspects of the embodiments may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, aspects of the embodiments may take the form of a computer program product embodied in one or more computer readable medium(s) having computer readable program code embodied thereon.

Any combination of one or more computer readable medium(s) may be utilized. The computer readable medium may be a computer readable storage medium (e.g., a non-transitory computer readable storage medium). A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Computer program code for carrying out operations for aspects of one or more embodiments may be written in any combination of one or more programming languages, including an object oriented programming language such as Java, Smalltalk, C++, or the like, and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

In some cases, aspects of one or more embodiments are described above with reference to flowchart illustrations and/or block diagrams of methods, apparatuses (systems), and computer program products. In some instances, it will be understood that each block of the flowchart illustrations and/or block diagrams, and combinations of blocks in the flowchart illustrations and/or block diagrams, can be implemented by computer program instructions. These computer program instructions may be provided to a special purpose computer, or other programmable data processing apparatus to produce a machine, such that the instructions, which execute via the processor of the computer or other programmable data processing apparatus, create means for implementing the functions/acts specified in the flowchart and/or block diagram block(s).

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block(s).

The computer program instructions may also be loaded onto a computer, other programmable data processing apparatuses, or other devices to cause a series of operational steps to be performed on the computer, other programmable apparatuses, or other devices to produce a computer implemented process such that the instructions which execute on the computer or other programmable apparatuses provide processes for implementing the functions/acts specified in the flowchart and/or block diagram block(s).

The flowchart and block diagrams in the Figures illustrate the architecture, functionality, and operation of possible implementations of systems, methods, and computer program products according to various embodiments. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of pre-AIA 35 U.S.C. section 112, sixth paragraph, unless the element is expressly recited using the phrase "means for" or "step for."

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the invention.

Though the embodiments have been described with reference to certain versions thereof; however, other versions are possible. Therefore, the spirit and scope of the appended claims should not be limited to the description of the preferred versions contained herein.

What is claimed is:

1. A method comprising:

determining a potential energy in a loudspeaker, a kinetic energy in the loudspeaker, and an electrical energy in the loudspeaker based on a physical model of the loudspeaker;

determining a total energy stored in the loudspeaker based on the potential energy, the kinetic energy, and the electrical energy;

determining a maximum potential displacement of a diaphragm of a speaker driver of the loudspeaker based on the total energy; and limiting the total energy stored in the loudspeaker by determining an instantaneous gain to apply to a source signal for reproduction via the loudspeaker based on the total energy, and attenuating the source signal based on the gain, wherein an actual displacement of the diaphragm during the reproduction of the source signal is controlled based on the attenuated source signal.

2. The method of claim 1, wherein the physical model is a linear model.

3. The method of claim 1, wherein the physical model is a nonlinear model.

4. The method of claim 1, further comprising:

recursively determining at least one of an estimated displacement of the diaphragm, an estimated velocity of the diaphragm, or an estimated current flowing through a driver voice coil of the speaker driver based on the physical model of the loudspeaker and a voltage of the source signal.

5. The method of claim 1, wherein:

determining the instantaneous gain is further based a set of parameters; and attenuating the source signal based on the gain comprises:

attenuating the gain by applying a smoothing algorithm to the gain; and applying the attenuated gain to a voltage of the source signal.

6. The method of claim 5, wherein the smoothing algorithm involves adjusting the gain exponentially utilizing at least one of an attack parameter or a release parameter.

7. The method of claim 1, wherein the actual displacement of the diaphragm during the reproduction of the source signal is limited based on the attenuated source signal.

8. The method of claim 1, wherein the actual displacement of the diaphragm during the reproduction of the source signal is compressed based on the attenuated source signal.

9. The method of claim 1, further comprising:

determining a state of the loudspeaker based on the physical model of the loudspeaker and the source signal, wherein the potential energy, the kinetic energy, and the electrical energy in the loudspeaker are determined based on the state of the loudspeaker.

10. A system for limiting energy in a loudspeaker, the system comprising:

a voltage source amplifier connected to the loudspeaker; and a limiter connected to the voltage source amplifier, wherein the limiter is configured to:

determine a potential energy in the loudspeaker, a kinetic energy in the loudspeaker, and an electrical energy in the loudspeaker based on a physical model of the loudspeaker;

determine a total energy stored in the loudspeaker based on the potential energy, the kinetic energy, and the electrical energy;

determine a maximum potential displacement of a diaphragm of a speaker driver of the loudspeaker based on the total energy; and limit the total energy stored in the loudspeaker by determining an instantaneous gain to apply to a voltage of a source signal for reproduction via the loudspeaker based on the total energy, and attenuating the voltage based on the gain, wherein the voltage source amplifier outputs the attenuated voltage to drive the speaker driver, and an actual displacement of the diaphragm during the reproduction of the source signal is controlled based on the attenuated voltage.

11. The system of claim 10, wherein the physical model is a linear model.

12. The system of claim 10, wherein the physical model is a nonlinear model.

13. The system of claim 10, wherein the limiter is further configured to:

recursively determine at least one of an estimated displacement of the diaphragm, an estimated velocity of the diaphragm, or an estimated current flowing through a driver voice coil of the speaker driver based on the physical model of the loudspeaker and the voltage.

14. The system of claim 10, wherein:

determining the instantaneous gain is further based on a set of parameters; and attenuating the voltage based on the gain comprises:

attenuating the gain by applying a smoothing algorithm to the gain; and applying the attenuated gain to the voltage.

15. The system of claim 14, wherein the smoothing algorithm involves adjusting the gain exponentially utilizing at least one of an attack parameter or a release parameter.

16. The system of claim 10, wherein the actual displacement of the diaphragm during the reproduction of the source signal is at least one of limited or compressed based on the attenuated voltage.

17. A loudspeaker device comprising:

a speaker driver including a diaphragm;

a voltage source amplifier connected to the speaker driver; and a limiter connected to the voltage source amplifier, wherein the limiter is configured to:

determine a potential energy in the loudspeaker device, a kinetic energy in the loudspeaker device, and an electrical energy in the loudspeaker device based on a physical model of the loudspeaker device;

determine a total energy stored in the loudspeaker device based on the potential energy, the kinetic energy, and the electrical energy;

determine a maximum potential displacement of the diaphragm of the loudspeaker device based on the total energy; and limit the total energy stored in the loudspeaker device by determining an instantaneous gain to apply to a voltage of a source signal for reproduction via the loudspeaker device based on the total energy, and attenuating the voltage based on the gain, wherein the voltage source amplifier outputs the attenuated voltage to drive the speaker driver, and an actual displacement of the diaphragm during the reproduction of the source signal is controlled based on the attenuated voltage.

18. The loudspeaker device of claim 17, wherein the physical model is one of a linear model or a nonlinear model.

19. The loudspeaker device of claim 17, wherein the limiter is further configured to:

recursively determine at least one of an estimated displacement of the diaphragm, an estimated velocity of the diaphragm, or an estimated current flowing through a driver voice coil of the speaker driver based on the physical model of the loudspeaker device and the voltage.

20. The loudspeaker device of claim 17, wherein:

determining the instantaneous gain is further based on a set of parameters; and attenuating the voltage based on the gain comprises:

attenuating the gain by applying a smoothing algorithm to the gain; and applying the attenuated gain to the voltage.

* * * * *